US005204724A

United States Patent [19]

Nakabayashi et al.

[11] Patent Number: 5,204,724

[45] Date of Patent: Apr. 20, 1993

[54] DOCUMENT FEEDING APPARATUS AND A DOCUMENT FEEDING METHOD WITH UPSTREAM PRESSURE RELEASE

[75] Inventors: Masayoshi Nakabayashi; Kaoru Suzuki, both of Yamatokoriyama, Japan

[73] Assignee: Sharp Kabushiki Kaisha, Osaka, Japan

[21] Appl. No.: 745,492

[22] Filed: Aug. 14, 1991

[30] Foreign Application Priority Data

| | | | |
|---|---|---|---|
| Aug. 16, 1990 | [JP] | Japan | 2-216552 |
| Aug. 16, 1990 | [JP] | Japan | 2-216553 |
| Aug. 16, 1990 | [JP] | Japan | 2-216554 |
| Sep. 7, 1990 | [JP] | Japan | 2-237836 |

[51] Int. Cl.[5] ..... G03G 15/00

[52] U.S. Cl. ..... 355/308; 271/273; 271/275

[58] Field of Search ..... 355/308, 309, 311, 316, 355/317, 318, 319, 320; 271/273, 274, 275

[56] References Cited

U.S. PATENT DOCUMENTS

| | | | |
|---|---|---|---|
| 3,988,019 | 10/1976 | Achelpohl | 271/274 X |
| 4,428,667 | 1/1984 | Phelps et al. | 355/317 |
| 4,705,389 | 11/1987 | Maekawa et al. | 355/319 X |
| 4,996,568 | 2/1991 | Hamakawa | 355/308 |
| 5,031,003 | 7/1991 | Hamano | 355/318 |

FOREIGN PATENT DOCUMENTS 52-12533 1/1987 Japan .

*Primary Examiner*—A. T. Grimley
*Assistant Examiner*—Sandra L. Brase
*Attorney, Agent, or Firm*—David G. Conlin; Robert F. O'Connell

[57] ABSTRACT

When a plurality of document sheets are sequentially transported by a belt to a document scanning area facing an optical scanning means, a clearance is formed between the belt and the document scanning area on the upstream side with respect to the document transporting direction. When a document is positioned in the document scanning area, a succeeding document is preliminarily transported until the leading edge thereof enters the clearance and contacts the belt. As a result, when the belt is driven to discharge the scanned document from the document scanning area, the succeeding document is quickly transported to the document scanning area. The time required for document transportation can thus be reduced.

16 Claims, 26 Drawing Sheets

Fig. 1 Prior Art
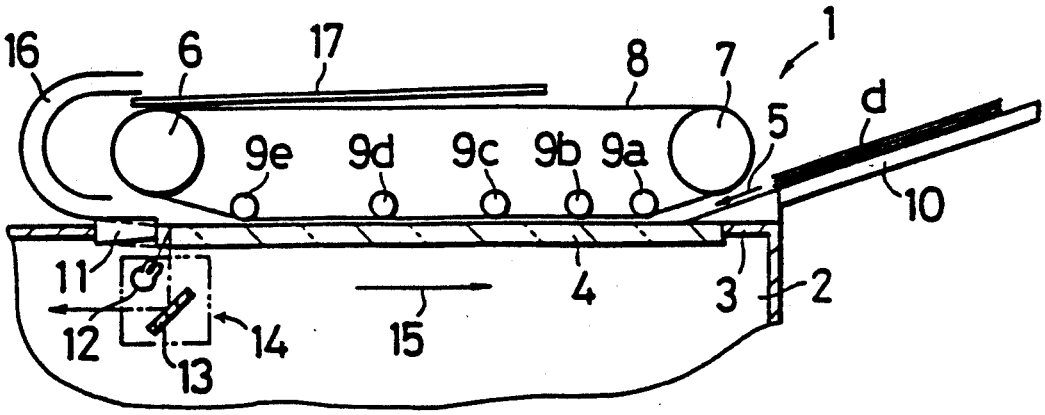
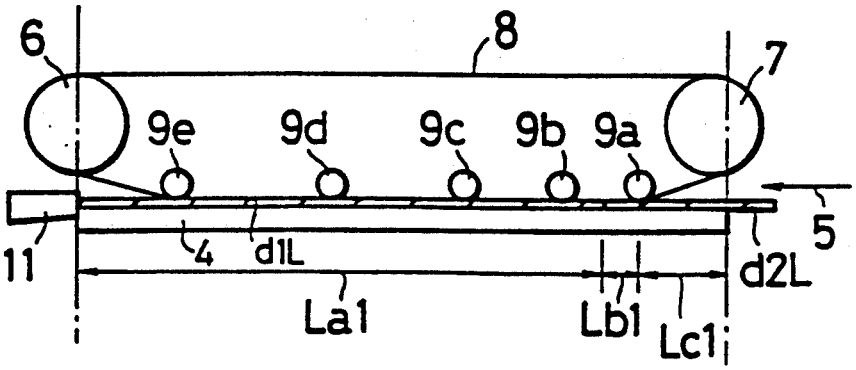
Fig. 2 (1) Prior Art
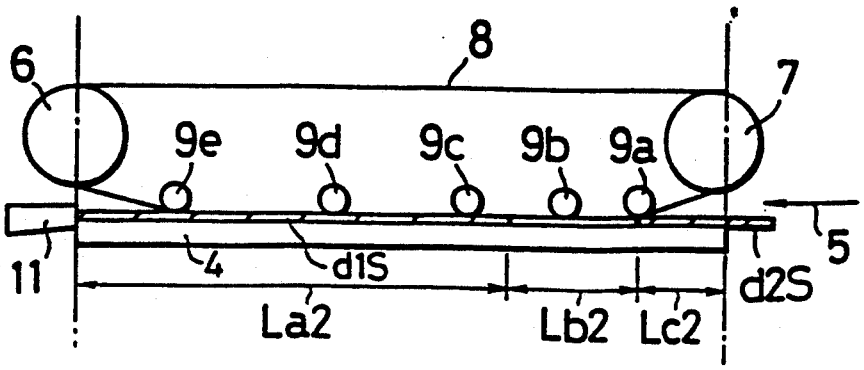
Fig. 2 (2) Prior Art

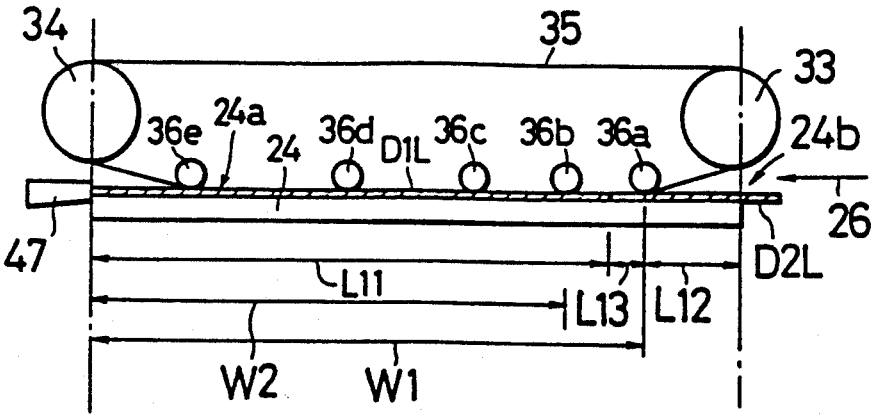
Fig. 8 (1)
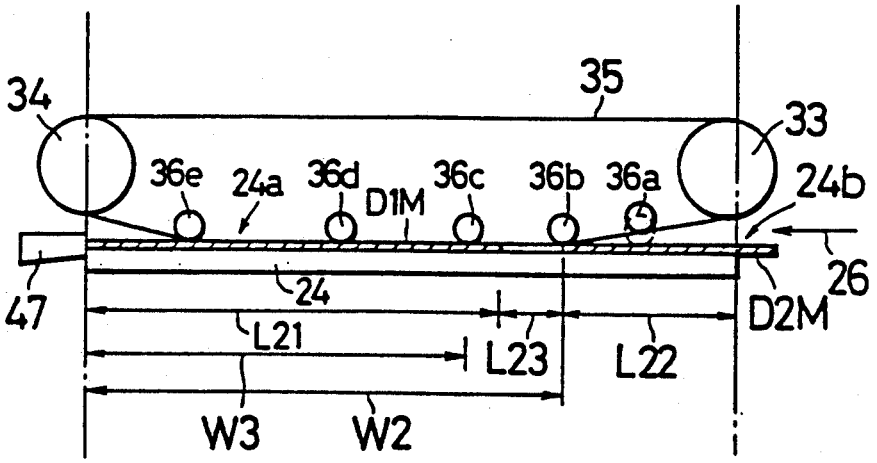
Fig. 8 (2)
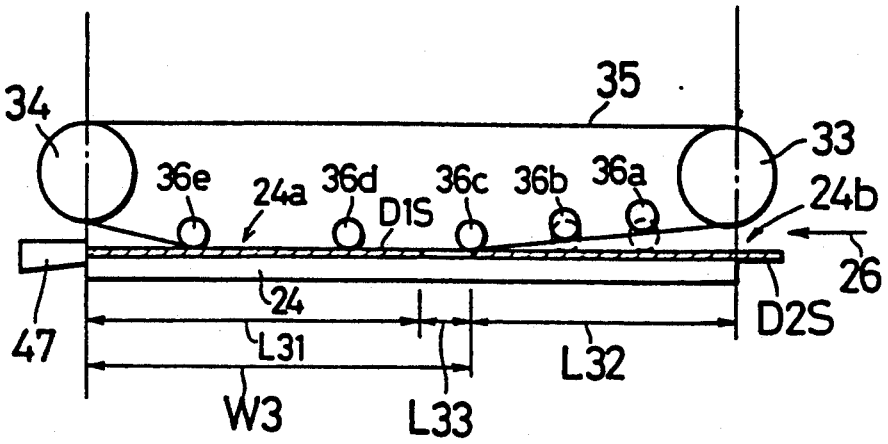
Fig. 8 (3)

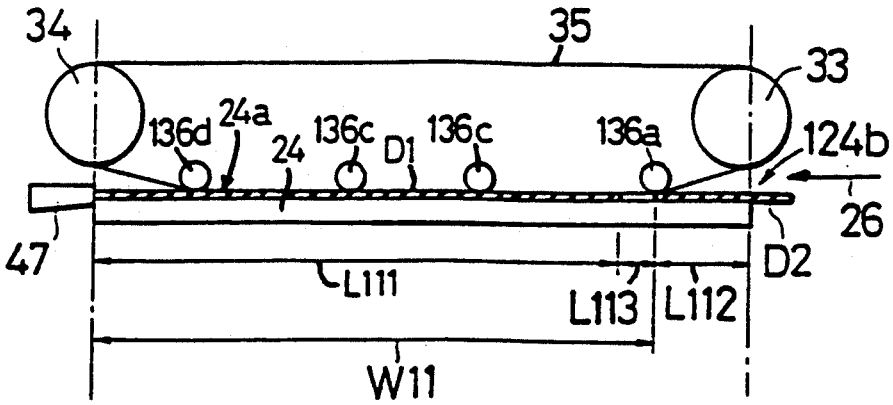
Fig. 15 (1)
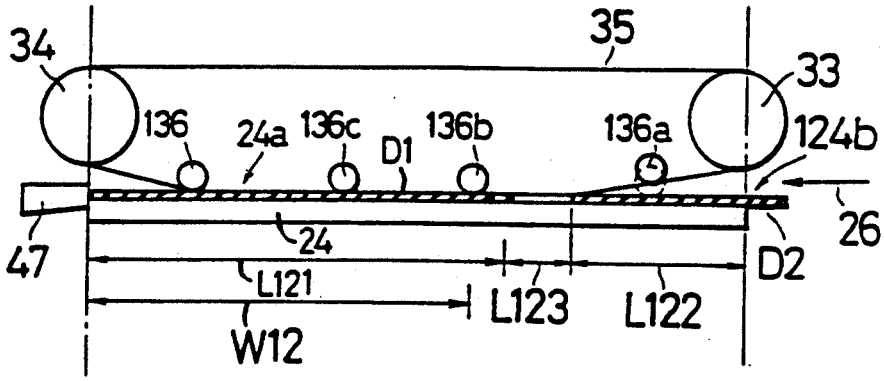
Fig. 15 (2)
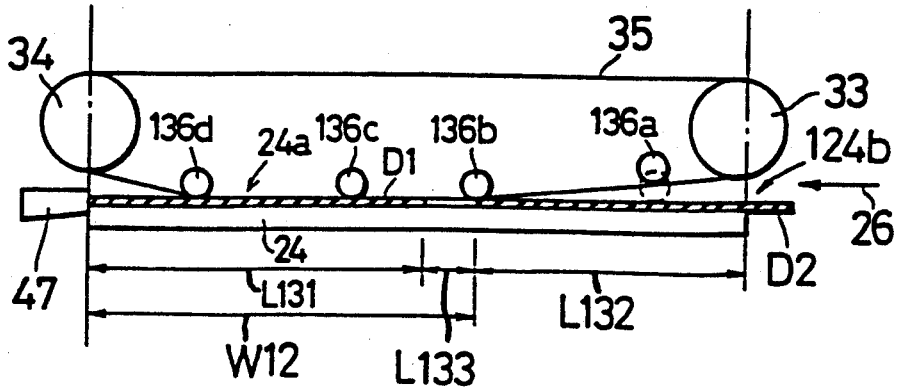
Fig. 15 (3)

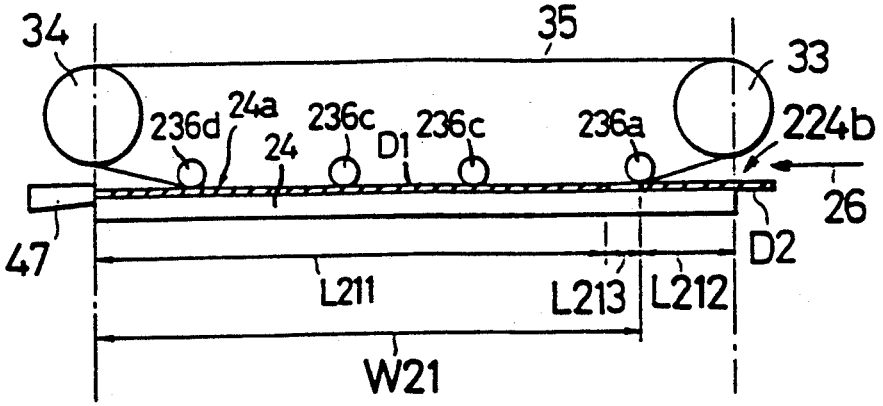
Fig.22 (1)
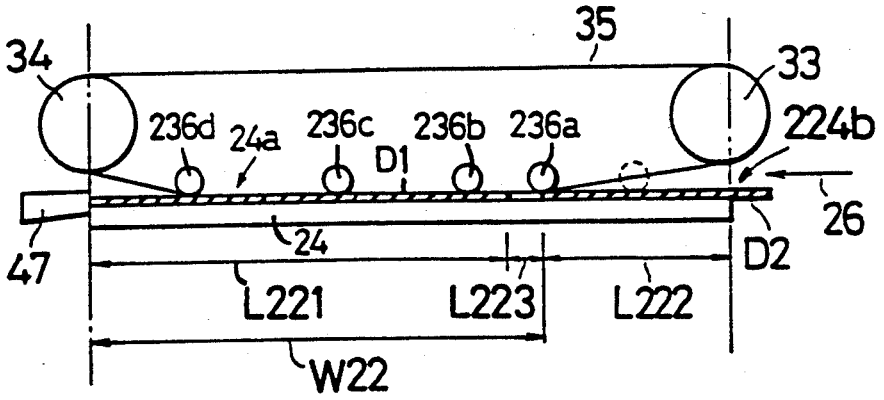
Fig.22 (2)
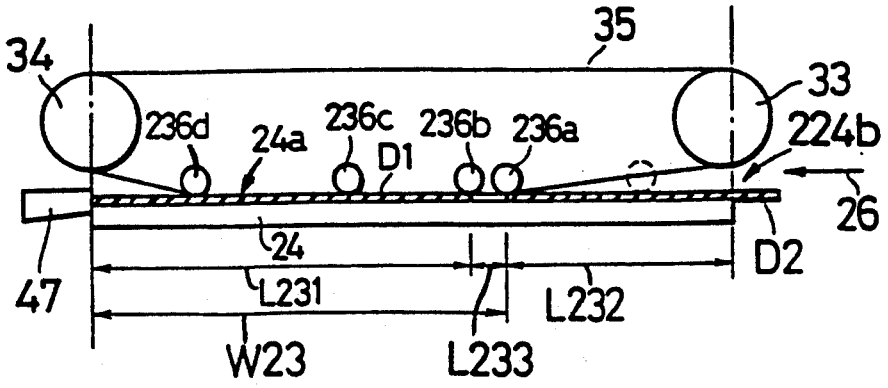
Fig.22 (3)

Fig. 29 (1)
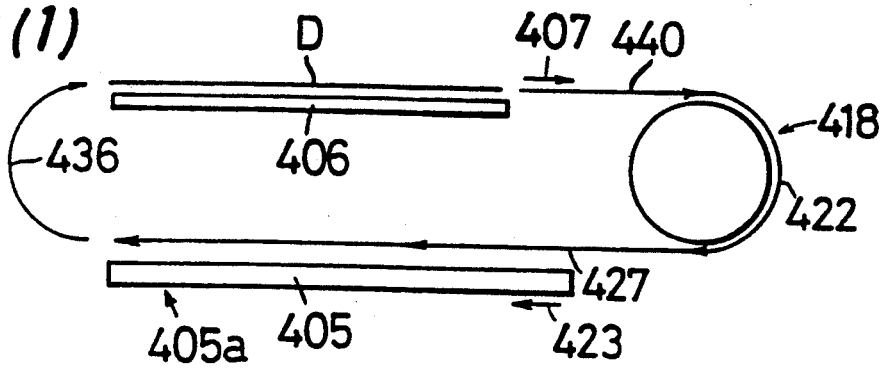
Fig. 29 (2)
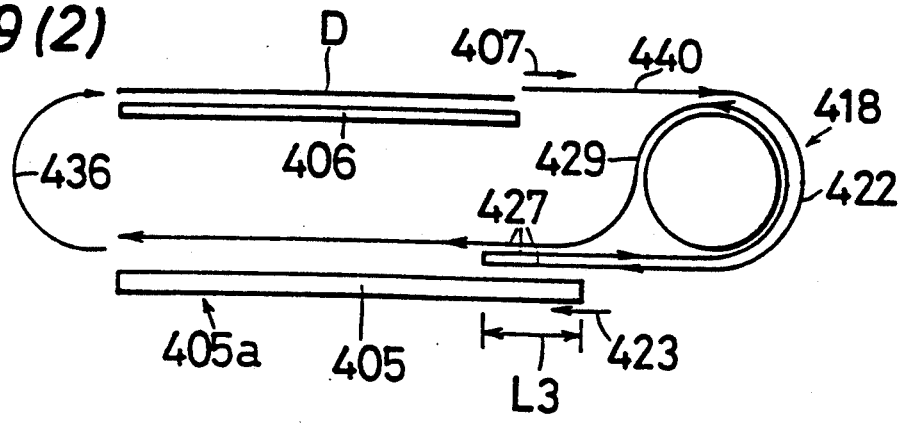

Fig. 31 (4)
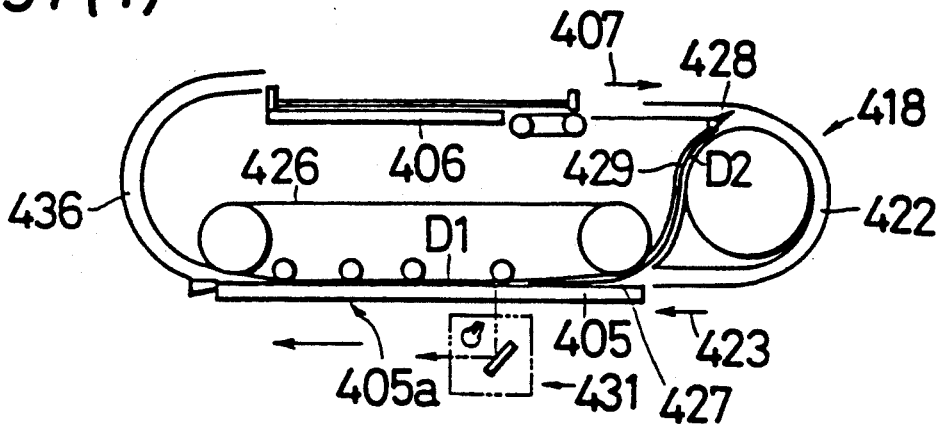
Fig. 31 (5)
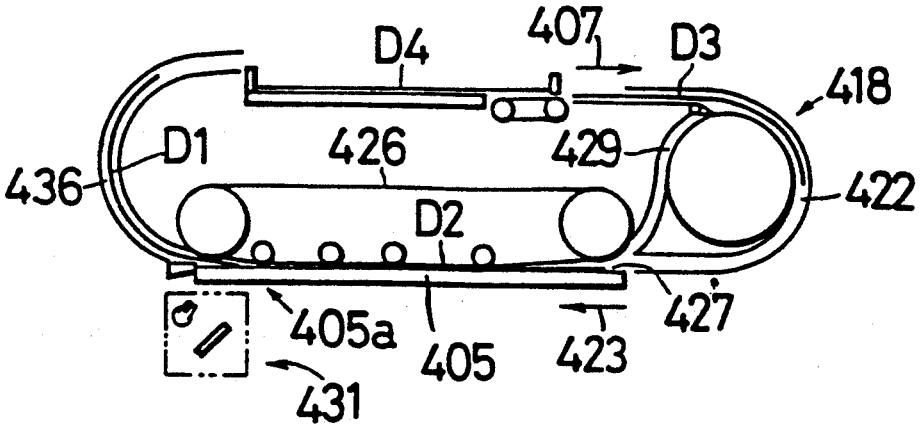

DOCUMENT FEEDING APPARATUS AND A DOCUMENT FEEDING METHOD WITH UPSTREAM PRESSURE RELEASE

BACKGROUND OF THE INVENTION

1. Field of the Invention

The present invention relates to a document feeding apparatus and a document feeding method used in a copying machine for feeding a plurality of document sheets sequentially to a document scanning area where the documents are scanned for exposure.

2. Description of the Prior Art

It is well known in the prior art to provide copying machines with automatic document feeding apparatus for automatically feeding a plurality of document sheets in sequential fashion to a document scanning area thereby alleviating the work of the operator. Images of the documents fed one by one to the document scanning area by the document feeding apparatus are scanned for exposure, thus accomplishing simplex (single-sided) or duplex (two-sided) copying in cooperation with the copying machine.

FIG. 1 is a cross sectional view schematically showing the structure of a document feeding apparatus 1 in a typical prior art example. The document feeding apparatus 1 is mounted, for example, on the top surface 3 of an electrostatic copying machine 2. A transparent plate 4 providing a document scanning area is fitted into the top surface 3. Documents d are fed in a transporting direction 5 and on to the transparent plate 4.

The document feeding apparatus 1 includes an endless belt 8 which are passed around a pair of rollers 6 and 7 disposed spaced apart along the transporting direction 5. On the inside of the endless belt 8 and adjacent to the lower taut portion thereof facing the transparent plate 4, there are disposed a plurality of pressure rollers 9*a*–9*e* in this order along the document transporting direction 5. The documents d stacked on a document loading tray 10 are fed one by one from the top of the stack in the transporting direction 5 by a document feeding means not shown, and the document d thus fed is transported along the upper surface of the transparent plate 4 by means of the belt 8 rotating in the clockwise direction (in FIG. 1) until the document d reaches the scanning position with its leading edge hitting a stop member 11. At this time, the pressure rollers 9*a*–9*e* apply pressure to press the document d against the transparent plate 4 via the belt 8 so as to prevent the document d being transported to the scanning position from lifting.

The document d transported to the scanning position is then scanned for exposure of the document image by moving an optical scanning means 14, including a light source 12, a reflecting mirror 13, etc., in the direction shown by arrow 15. After the document d has been scanned at the scanning position, a solenoid not shown is actuated to release the stop member 11 from the document d and the belt 8 are restarted for rotation to discharge the document d through a transport path 16 onto a document exit tray 17. The above feeding operation is sequentially performed on the documents d stacked on the document loading tray 10.

In the above construction that sequentially feeds a plurality of sheet documents to the scanning position, the time it takes to feed the document subsequent to the previously fed one greatly affects the time it takes for the whole copying operation.

FIG. 2 shows diagrams explaining problems with the prior art construction. A document to be fed first is designed by reference numeral d1 and a document to be fed subsequently to the first one is designated by d2. When the document size is to be designated, a suffix L (meaning large size) or S (meaning small size) is attached to the same reference numerals. The document d1 fed first is transported by means of the belt 8 until reaching the scanning position where it contacts the stop member 11. When the document d1 has reached the scanning position, the rotation of the belt 8 stops and the document d1 is scanned by the optical scanning means 14. While the document d1 is being scanned, the succeeding document d2 is transported to a halfway position on the transparent plate 4.

In the above prior art construction, the pressure against the belt 8 of the pressure rollers 9*a*–9*e* are not individually controlled. In other words, all the pressure rollers 9*a*–9*e* are pressed against the transparent plate 4 via the belt 8, so as to prevent the document at the scanning position from lifting. As a result, on the downstream side from the upstream end pressure roller 9*a* with respect to the transporting direction, the belt 8 and the transparent plate 4 are pressed against each other with the document d1 interposed therebetween. Since the belt 8 are not rotating during the scanning period, the document d2 is subjected only to the transporting force by the document feeding means and cannot be made to enter the space between the belt 8 and the transparent plate 4 on the downstream side of the pressure roller 9*a* in the transporting direction. That is, during the scanning of the leading document d1, the succeeding document d2 can only be fed to a standby position where the leading edge thereof reaches the upstream end pressure roller 9*a*. Feeding the document d2 further downstream of that position is not possible since it would cause the leading edge thereof to be bent or jammed.

FIG. 2(1) shows the condition in which a document d1L having a length La1 along the transporting direction 5 has been transported to the scanning position. During the scanning of the document d1L, the succeeding document d2L can be transported to the position of the pressure roller 9*a* to stand by at that position. In other words, the succeeding document d2L can be preliminarily transported on the transparent plate 4 by a distance Lc1 and d2L. This means that when the rotation of the belt 8 is restarted after completing the scanning of the document d1L, the succeeding document d2L is transported by the length La1 plus the distance Lb1 to reach the scanning position.

FIG. 2(2) shows the condition in which a document d1S having a length La2 along the transporting direction 5 has been transported to the scanning position. In this case, the following relationship holds.

$$La1 > La2 \quad (1)$$

In the prior art construction, even in the case of the document d2S with a smaller size, the succeeding document d2S can only be transported to the position of the pressure roller 9*a* for standby as described above. Therefore, the distance Le2 over which the document d2S is preliminarily transported on the transparent plate 4 is expressed by the following relation.

$$Lc1 = Lc2 \quad (2)$$

Therefore, the distance Lb2 between the documents d1S and d2S has the following relationship with respect to the distance Lb1 between the larger sized documents d1L and d2L.

$$Lb1 < Lb2 \quad (3)$$

However, the distance over which the succeeding document d2S is transported to the scanning position after completing the scanning of the leading document d1S is expressed as the length La2+the distance Lb2, which is equal to the distance over which the larger sized document d2L is transported to the same position. That is, since the standby position of the succeeding document d2 is the same despite the difference in size, the time needed to transport a plurality of document sequentially to the scanning position is the same regardless of the document size.

As is apparent from FIG. 2, the distance between the documents transported becomes larger as the size of the document d becomes smaller. If the distance can be reduced, the time to transport the succeeding document d2 to the scanning position following the preceding document d1 can be shortened, which can contribute to a significant reduction in the time needed to transport a plurality of documents sequentially to the scanning position.

As described earlier, increasing numbers of copying machines are being provided with automatic document feeding apparatus for automatically feeding a plurality of sheet documents in sequential fashion to a document scanning area thereby alleviating the work of the operator. The documents to be copied are stacked on a document loading tray and are fed sequentially from the bottom of the stack, for example. The documents are transported by means of transport belts sequentially to the document scanning area with the document image to be copied facing the interior side of the copying machine, and the thus positioned document image is scanned by an optical scanning means, for example, thus accomplishing simplex (single-sided) or duplex (two-sided) copying in cooperation with the copying machine.

In order to transport and position the document first with one side thereof facing the document scanning area and then with the other side thereof facing it, there is provided, for example, an inverting means between the document loading tray and the document scanning area. The inverting means consists of a first transport path and a second transport path provided between the document loading tray and the document scanning area. For simplex (single-sided) copying, the document fed from the document loading tray is turned over by passing through the first transport path and is then transported with the image side thereof facing the document scanning area. On the other hand, for duplex (two-sided) copying, the document fed from the document loading tray is first transported into the first transport path where the transport direction is reversed and is then directed into the second transport path, after which the document is transported to the document scanning area. As a result, the document is positioned with the reverse thereof facing the document scanning area without having to turn back the document placed on the document loading tray. After the reverse side has been scanned, the document is returned with its sides inverted, after which the document is refed through the first and second transport paths, thereby allowing the remaining side, i.e. the top side, of the document to be scanned for exposure.

As described, in the construction in which a plurality of document sheets are sequentially fed to the scanning area, the time it takes to feed a next document subsequent to the preceding document greatly affects the time the whole copying operation takes. Therefore, there can be considered a construction in which the succeeding document is preliminarily fed to a standby position as close as possible to the preceding document while the preceding document stationary on the document scanning area is being scanned by the optical scanning means, thereby shortening the time needed to transport a plurality of documents sequentially to the document scanning area. The construction in which the succeeding document is preliminarily fed to a standby position as described above is generally known as preliminary feeding, an example of which is disclosed in Japan Laid Open No. 62-12533. According to the construction disclosed therein, the succeeding document preliminarily fed is placed on standby immediately before the transparent plate that provides the document scanning area.

In preliminary feeding for duplex (two-sided) copying, for example, the document fed from the document loading tray must first be passed through the first transport path and inverted before being passed through the second transport path, as described above. Therefore, in order to accomplish the preliminary feeding in the case of a document having a relatively large dimension along the transporting direction, the first transport path must have a sufficient length that can accommodate that dimension. This tends to increase the size of the inverting means. In other words, if the inverting means is reduced in size, preliminary feeding cannot be performed in the case of a larger sized document. On the other hand, increasing the path length by enlarging the inverting means results in an increase in the transporting time of the document. The increase in the transporting time is particularly appreciable in the case of simplex(-single-side) copying in which the document is transported only through the first transport path. Thus, there is a limit to the reduction of the time needed to sequentially transport a plurality of documents, which presents an obstacle to the reduction of the copying time.

SUMMARY OF THE INVENTION

It is an object of the invention to provide a document feeding apparatus, as well as a document feeding method, which is simple in construction and which accomplishes a marked reduction in the time needed to feed a plurality of document sheets sequentially to a document scanning area.

The document feeding apparatus of the invention comprises:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, a prescribed number of pressure rollers counted from the upstream end in the transporting directions are controlled individually in the sequence in which they are arranged in such a manner as to release their pressures from the belt in accordance with the length of the document measured along the transporting direction.

According to the invention, the plurality of pressure rollers apply pressure to press the document being transported by the belt against the document scanning area via the belt. In the invention, the plurality of pressure rollers are individually controlled in terms of their pressures according to the size of the document measured along the transporting direction thereof. In particular, when the preceding document is positioned on the document scanning area, a prescribed number of pressure rollers counted from the upstream end in the transporting direction are controlled individually in the sequence in which they are arranged in such a manner as to release their pressures from the belt in accordance with the length of the transported document. Accordingly, as the document size is reduced, a wider clearance is provided upstream with respect to the transporting direction between the belt and the document scanning area, which results in a marked reduction in the distance between the preceding document and the succeeding document preliminarily fed to a standby position. This also means a marked reduction in the time needed to transport the succeeding document to the document scanning area, which in turn markedly reduces the total time needed to sequentially transport a plurality of documents.

According to the invention, a plurality of pressure rollers on the upper stream side are controlled by a simple construction and in a prescribed combination in such a manner as to release their pressures from the belt in accordance with the reduction in the size of the preceding document. As a result, a clearance is formed between the belt and the document scanning area so that the document to be fed subsequently to the preceding document can be transported to a standby position as close as possible to the preceding document. This serves to markedly reduce the time needed to transport the succeeding document to the document scanning area while the preceding document is being discharged, which eventually leads to a marked reduction in the time needed to transport a plurality of documents sequentially to the document scanning area. Accordingly, the copying time in a copying machine equipped with the above document feeding apparatus can be reduced markedly.

The invention is characterized in that the plurality of pressure rollers controlled to release pressure include a first pressure roller disposed at the upstream end with respect to the transporting direction and a second pressure roller disposed on the downstream side of the first pressure roller with respect to the transporting direction.

The invention is also characterized in that a stop member is provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and the first pressure roller but greater than the distance between the stop member and the second pressure roller, the first and second pressure rollers are not controlled to release pressure, allowing the succeeding document to be fed until the leading edge thereof contacts the first pressure roller via the belt.

Furthermore, the invention is characterized in that

Furthermore, the invention is characterized in that when the length, measured along the transporting direction, of the document positioned on the document scanning area is smaller than the distance between the stop member and the second pressure roller but greater than the distance between the stop member and a third pressure roller disposed on the downstream side of the second pressure roller in the transporting direction, the first pressure roller is controlled so as to release its pressure so that the succeeding document is fed until the leading edge thereof contacts the second pressure roller via the belt.

The invention is characterized in that when the length, measured along the transporting direction, of the document positioned on the document scanning area is smaller than the distance between the stop member and the third pressure roller, the first and second pressure rollers are controlled so as to reduce their pressures so that the succeeding document is fed until the leading edge thereof contacts the third pressure roller via the belt.

The document feeding apparatus of the invention comprises:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, the pressure roller disposed at the upstream end with respect to the transporting direction is controlled in such a manner as to reduce its pressure according to the length of the document measured along the transporting direction.

According to the invention, the plurality of pressure rollers apply pressure to press the document being transported by the belt against the document scanning area via the belt. In the invention, the plurality of pressure rollers are individually controlled in terms of their pressures according to the size of the document measured along the transporting direction thereof. In particular, when the preceding document is positioned on the document scanning area, the pressure roller disposed at the upstream end with respect to the transporting direction is controlled in such a manner as to reduce its pressure according to the reduction in the size of the transported document. Accordingly, as the document size is reduced, a wider clearance is provided upstream with respect to the transporting direction between the belt and the document scanning area, which results in a marked reduction in the distance between the preceding document and the succeeding document preliminarily fed to a standby position. This also means a marked reduction in the time needed to transport the succeeding document to the document scanning area, which in turn markedly reduces the total time needed to sequentially transport a plurality of documents.

According to the invention, the pressure roller at the upstream end with respect to the transporting direction is controlled by a simple construction in such a manner as to release its pressure from the belt in accordance with the reduction in the size of the preceding document. As a result, a clearance is formed between the belt and the document scanning area so that the document to be fed subsequently to the preceding document can be transported to a standby position as close as possible to the preceding document. This serves to markedly reduce the time needed to transport the succeeding document to the document scanning area while the preceding document is being discharged, which eventually leads to a marked reduction in the time needed to transport a plurality of documents sequentially to the document scanning area. Accordingly, the copying time in a copying machine equipped with the above document feeding apparatus can be reduced markedly.

The invention is characterized in that said pressure roller is moved vertically in a stepwise manner between the lowermost position at which said pressure roller is pressed against the document scanning area via the belt and the uppermost position at which said pressure roller is not in contact with the belt.

The invention is also characterized in that a stop member is provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and said pressure roller but greater than the distance between the stop member and the other pressure roller disposed downstream of said pressure roller, the amount of elevation of said pressure roller is controlled in accordance with the length of the document so that the succeeding document is fed until the leading edge thereof contacts the belt.

Furthermore, the invention is characterized in that when the length, measured along the transporting direction, of the document positioned on the document scanning area is smaller than the stop member and the other pressure roller, said pressure roller is moved up to the uppermost position so that the succeeding document is fed until the leading edge thereof contacts the other roller via the belt.

The document feeding apparatus of the invention comprises:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, the pressure roller disposed at the upstream end with respect to the transporting direction is controlled in such a manner as to shift its pressing position toward the downstream side in the transporting direction in accordance with the length of the document measured along the transporting direction.

According to the invention, the plurality of pressure rollers apply pressure to press the document being transported by the belt against the document scanning area via the belt. In the invention, the plurality of pressure rollers are individually controlled according to the size of the document measured along the transporting direction thereof. In particular, when the preceding document is positioned on the document scanning area, the pressure roller disposed at the upstream end with respect to the transporting direction is controlled in such a manner as to shift its pressing position toward the downstream side in the transporting direction in accordance with the reduction in the size of the transported document. As a result, as the document size is reduced, the clearance formed between the belt and the document scanning area upstream of the upstream end pressure roller is expanded toward the downstream side in the transporting direction, which results in a marked reduction in the distance between the preceding document and the succeeding document preliminarily fed to a standby position. This also means a marked reduction in the time needed to transport the succeeding document to the document scanning area, which in turn markedly reduces the total time needed to sequentially transport a plurality of documents.

According to the invention, the pressure roller at the upstream end with respect to the transporting direction is controlled by a simple construction in such a manner as to shift its pressing position toward the downstream side in the transporting direction in accordance with the reduction in the size of the preceding document. As a result, the clearance formed between the belt and the document scanning area upstream of the upstream end pressure roller expands toward the downstream side in the transporting direction so that the document to be fed subsequently to the preceding document can be transported to a standby position as close as possible to the preceding document. This serves to markedly reduce the time needed to transport the succeeding document to the document scanning area while the preceding document is being discharged, which eventually leads to a marked reduction in the time needed to transport a plurality of documents sequentially to the document scanning area. Accordingly, the copying time in a copying machine equipped with the above document feeding apparatus can be reduced markedly.

The invention is characterized in that the upstream end pressure roller is displaced in a stepwise manner between a first prescribed position and a second position downstream of the first position in the transporting direction.

The invention is also characterized in that a stop member is provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and the first position but greater than the distance between the stop member and the second position, the amount of the displacement of the upstream end pressure roller is controlled in accordance with the length of the document so that the subsequent document is fed until the leading edge thereof contacts the upstream end pressure roller via the belt.

Furthermore, the invention is characterized in that when the length, measured along the transporting direction, of the document positioned on the document scanning area is smaller than the distance between the stop member and the second position, the upstream end pressure roller is moved to the second position so that the succeeding document is fed until the leading edge thereof contacts the upstream end pressure roller via the belt.

Another object of the invention is to provide a document feeding apparatus, as well as a document feeding method, which achieves a reduction in the size of an inverting means by a simple construction and which ensures reliable implementation of preliminary feeding and thus achieves a reduction in the copying time.

To accomplish the above object, the invention provides a document feeding apparatus for feeding document sheets stacked on a document loading tray and transporting the document sheets sequentially and successively by a belt to a document scanning area facing optical scanning means, wherein:

inverting means having a first and a second branching transport path for reversing the transporting direction of the document for duplex copying or for turning over the document for simplex copying is provided between the document loading tray and the document scanning area; and a clearance is formed between the belt and the document scanning area on the upstream side with respect to the transporting direction, the clearance serving as a third transport path into which the transport paths of the inverting means merge.

According to the invention, on the upstream side of the document scanning area with respect to the transporting direction where the first and the second transport path of the reversing means merge, there is formed a clearance between the document scanning area and the belt that transports the document. The clearance serves as a third transport path that communicates with the first and the second transport path of the inverting means.

Therefore, in the case of handling a large size document, the third transport path serves to supplement the path length necessary for reversing the document transporting direction or turning over the document, which permits a marked reduction in the overall size of the inverting means constructed with the first and the second transport path. Since the necessary path length is secured despite the reduction in the size of the inverting means, a succeeding document can be preliminarily fed in a reliable manner while the preceding document is being scanned. Furthermore, the implementation of the preliminary feeding, coupled with the reduction in the size of the inverting means, makes it possible to markedly reduce the total transporting time when handling a plurality of documents, thereby achieving a reduction in the copying time.

According to the invention, since the path length necessary for reversing the document transporting direction or turning over the document being transported is supplemented by the provision of the third transport path formed on the document scanning area, the inverting means constructed with the first and the second transport path can be markedly reduced in size.

Also, since the path length necessary for document transportation is secured despite the reduction in the size of the inverting means, preliminary feeding of a document can be accomplished in a reliable manner whatever the size of the document.

Furthermore, because of the reduced size of the inverting means and the implementation of the preliminary feeding, the time needed to transport the preliminarily fed document to the document scanning area can be significantly reduced, which eventually leads to a marked reduction in the copying time.

The invention is characterized in that when the document is positioned on the document scanning area, the succeeding document is transported for standby until the leading edge thereof enters the third transport path and contacts the belt.

The invention also provides a document feeding method for feeding document sheets stacked on a document loading tray and transporting the document sheets successively by a belt to a document scanning area facing an optical scanning means, wherein:

forming a clearance between the belt and the document scanning area on the upstream side with respect to the document transporting direction; and transporting the succeeding document for standby until the leading edge thereof enters the clearance and contacts the belt, when the document is positioned on the document scanning area.

BRIEF DESCRIPTION OF THE DRAWINGS

Other and further objects, features, and advantages of the invention will be more explicit from the following detailed description taken with reference to the drawings wherein:

FIG. 1 is a cross sectional view schematically showing the structure of a prior art document feeding apparatus 1;

FIGS. 2(1) and 2(2) are diagrams explaining problems with the prior art construction;

FIGS. 8(1)–8(3) are diagrams explaining the operation for positioning the pressure rollers 36*a*–36*e* in the first embodiment;

FIGS. 15(1)–15(3) are diagrams explaining the operation for positioning the pressure rollers 136*a*–136*d* in the second embodiment;

FIGS. 22(1)–22(3) are diagrams explaining the operation for positioning the pressure rollers 236*a*–236*d* in the third embodiment;

FIGS. 29(1) and 29(2) are diagrams explaining how a document D is transported in the document feeding apparatus 401 in various copy modes;

DETAILED DESCRIPTION OF THE PREFERRED EMBODIMENTS

Figure 3:
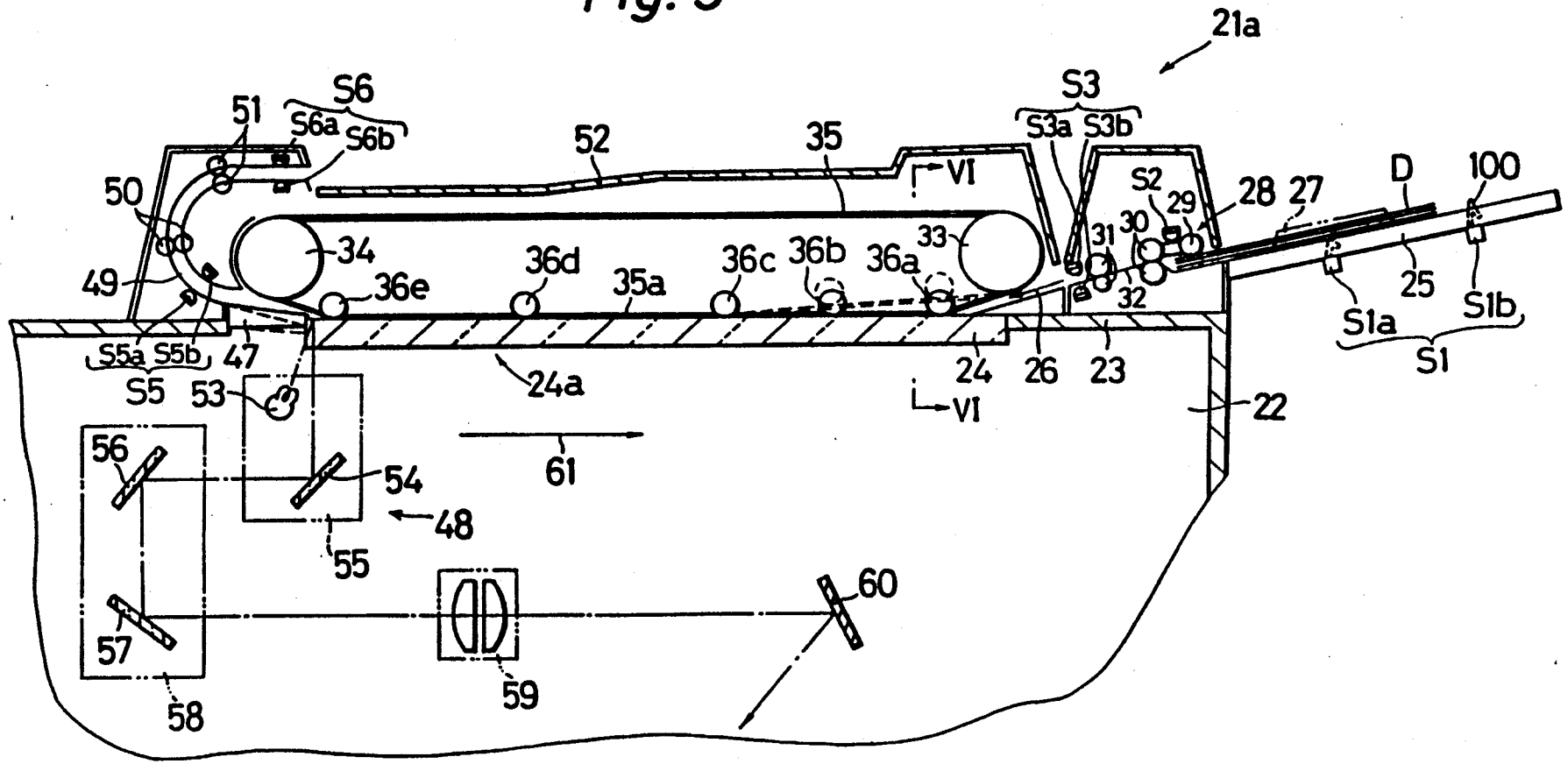
FIG. 3 is a cross sectional view schematically showing the structure of a document feeding apparatus 21*a* in a first embodiment of the invention.

Now referring to the drawing, preferred embodiments of the invention are described below.

EMBODIMENT 1

Figure 4:
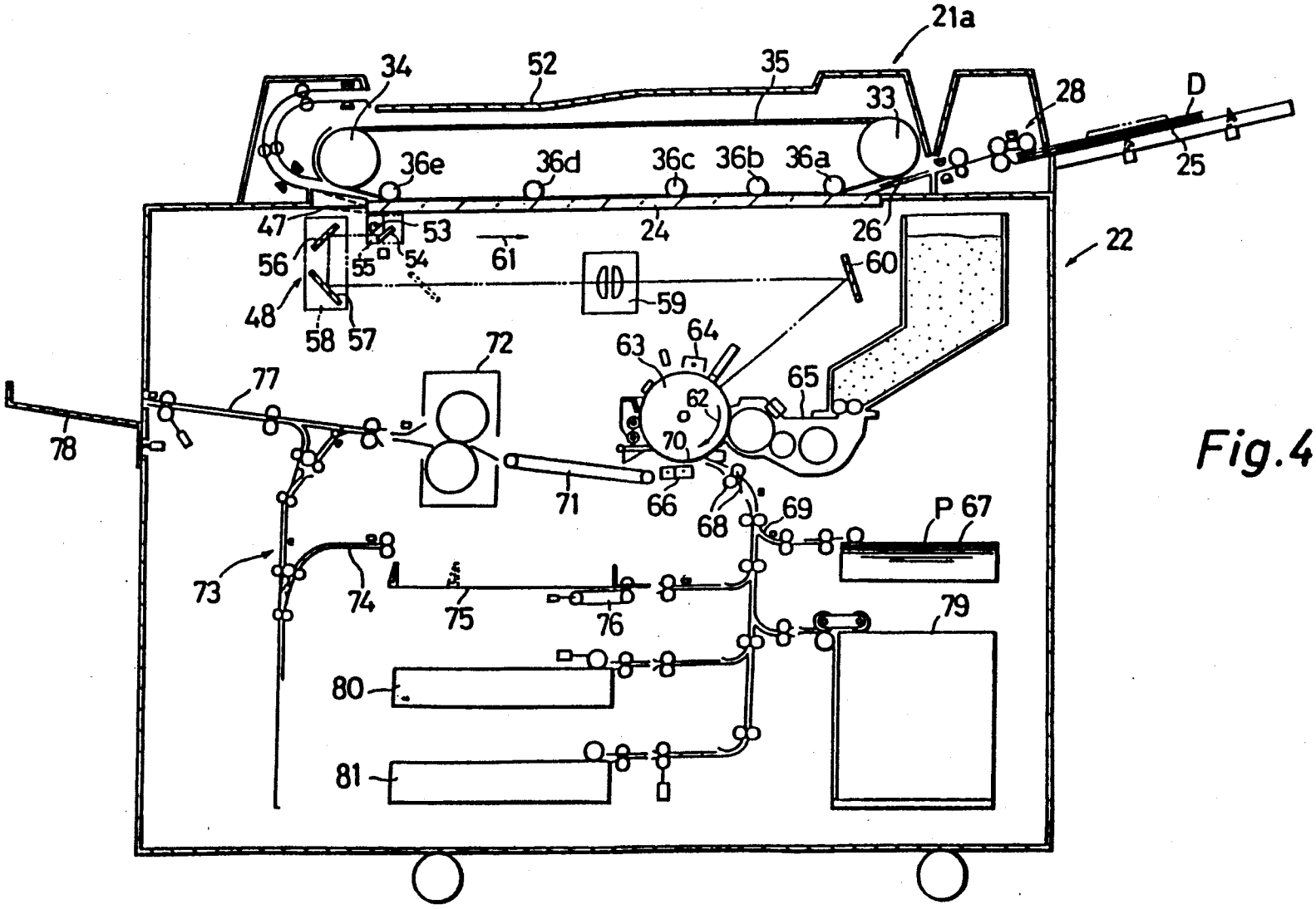
FIG. 4 is a cross sectional view schematically showing the structure of an electrostatic copying machine 22 equipped with the document feeding apparatus 21*a;*

FIG. 3 is a cross sectional view schematically showing the structure of a document feeding apparatus 21*a* in a first embodiment of the invention, and FIG. 4 is a cross sectional view schematically showing the structure of an electrostatic image transfer copying machine 22 equipped with the document feeding apparatus 21*a*. The document feeding apparatus 21*a* is mounted on the top surface 23 of the copying machine 22. A transparent plate 24 formed from hard glass or other material and providing a document scanning area is fitted into the top surface 23. A document image facing the interior side of the copying machine 22 from a prescribed scanning position 24*a* on the transparent plate 24 is scanned optically, for example, and is copied onto recording paper P as will be described hereinafter. The document feeding apparatus 21*a* is rotatable about an axis of rotation (not shown) extending, for example, in the horizontal direction in FIG. 3. The rotatable construction allows the document feeding apparatus 21*a* to be opened to expose the transparent plate 24 so that a document having a substantial thickness, such as a book, can be placed for scanning on the transparent plate 24.

Usually, the document feeding apparatus 21*a* is mounted covering the transparent plate 24 as shown in FIGS. 3 and 4, so that document sheets D stacked on a document loading tray 25 are automatically and sequentially fed for exposure on the scanning area for simplex (single-sided) or duplex (two-sided) copying on the recording paper P.

Referring to FIG. 3, the structure of the document feeding apparatus 21*a* is described below.

The document loading tray 25 is mounted on the right side of the top surface in FIG. 3. Document sheets D to be copied are stacked on the document loading tray 25. The document loading tray 25 is provided with a pair of alignment plates 27 disposed opposite each other across the width of the stacked documents D which are fed in direction 26 parallel to the alignment plates 27. The alignment plates 27 are movable by hand closer to and away from the widthwise sides of the stacked documents D and are used to limit the positions of the widthwise sides of the documents D. Being limited by the alignment plates 27, the widthwise center of the stacked documents D is always at the same position regardless of the size thereof.

The document loading tray 25 is also provided with a size detecting device S1. As shown in FIG. 3, the size detecting device S1 is made up of a pair of detectors S1*a*, S1*b* spaced apart along the document transporting direction 26, each detector being formed for example from a pawl 100 protruding above the surface of the document loading tray 25 on which the documents D are placed. When the documents D are placed on the document loading tray 25, the protruding pawl 100 is depressed by the weight of the documents D. By checking the combinations of the depressed pawls 100 at the pair of size detectors S1*a* and S1*b*, it is possible to roughly identify the size, measured along the document transporting direction 26, of the documents D stacked on the document loading tray 25. Further, by combining the detection result of the size detecting device S1 with the positioning limits provided by the alignment plates 27, it is possible to determine the overall size of the stacked documents D. However, when the stacked documents D consist of different size sheets, such as Japan Industrial Standard A4 size and A3 size sheets, all the dimensions of the sheets are not recognized but the size is determined based on the combinations of the depressed pawls 100.

Above the stacked documents D is disposed a document detector S2 formed for example from an optical sensor or the like. The document detector S2 detects the presence or absence of the documents D on the document loading tray 25.

Above the stacked documents D and adjacent to the leading edge thereof, there is disposed a document feeding means 28. As shown in FIG. 3, the document feeding means 28 comprises, for example, a roller 29 which contacts the top sheet of the stacked documents D and feeds the documents D one by one in successive manner from the top of the stack. The document feeding means 28 need not necessarily be constructed with the above roller 29, but may be constructed with a suction transport means, for example.

The document D fed by the document feeding means 28 is transported in the transporting direction 26 along a transport path 32 by means of transport rollers 30 and 31 and is delivered onto the transparent plate 24. In the transport path 32, there is disposed a sheet length detector S3 comprising, for example, a light emitting element S3*a* and a light receiving element S3*b*. The sheet length detector S3 calculates the size of the document D measured along the transporting direction 26 from the document transport speed being delivered by the transport rollers 30 and 31 and the length of time during which the light emitted from the light emitting element S3*a* toward the light receiving element S3*b* is blocked by the passing document D. Thus, in the case of different size documents D stacked on the document loading tray 25, even if the size of the document D cannot be recognized by the size detecting device S1, the size measured along the transporting direction 26 can be identified by the sheet length detector S3 when the document D is being transported toward the transparent plate 24.

Disposed above the transparent plate 24 and spaced apart along the document transporting direction 26 are a pair of rollers 33 and 34 each having an axis extending in the widthwise direction of the document D. An endless belt 35 is passed around the pair of rollers 33 and 34. On the inside of the belt 35 and adjacent to the lower taut portion 35*a* thereof, there are disposed a plurality of pressure rollers 36*a*–36*e* (five in this embodiment) spaced apart in this order along the transporting direction 26. The pressure rollers 36*a*–36*e* apply pressure to press the belt 35 against the transparent plate 24, thus keeping the belt 35 from slacking while preventing the document D fed between the belt 35 and the transparent plate 24 from lifting.

In this embodiment, the pressures applied to the belts by the respective pressure rollers 36*a*–36*e* are controlled individually. In FIG. 3, the pressure rollers 36*a* and 36*b* disposed on the upper stream side with respect to the document transporting direction 26 are controlled so as to apply or release their pressures according to the size of the supplied document D measured in the transporting direction 26. On the other hand, the other pressure rollers 36*c*–36*e* are controlled to apply constant pressure to the belt 35 regardless of the size of the supplied document D.

Figure 5:
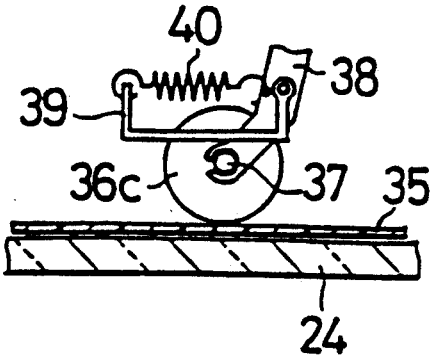
FIG. 5 is a side view schematically showing the structure of a pressure roller 36*c;*

FIG. 5 is a side view schematically showing the structure of the pressure roller 36*c*. Although FIG. 5 illustrates the pressure roller 36*c*, it should be noted that the pressure rollers 36*d* and 36*e*, which are controlled in the same manner as the pressure roller 36*c*, have the same construction as the one shown in FIG. 5. The pressure roller 36*c* is mounted on an axle 37 having an axis extending in parallel to the widthwise direction of the document D being transported, each end of the axle 37 being supported rotatably by a support shaft 38. A linkage member 39 is connected to the support shaft 38, and a coil spring 40 for applying pressure is mounted extending between the linkage member 39 and the support shaft 38. The spring force of the spring 40 causes the pressure roller 36*c*, via the support shaft 38, to apply pressure to the belts 35. The pressure rollers 36*c*–36*e* thus apply constant pressure to press the belt 35 against the transparent plate 24.

Figure 6:
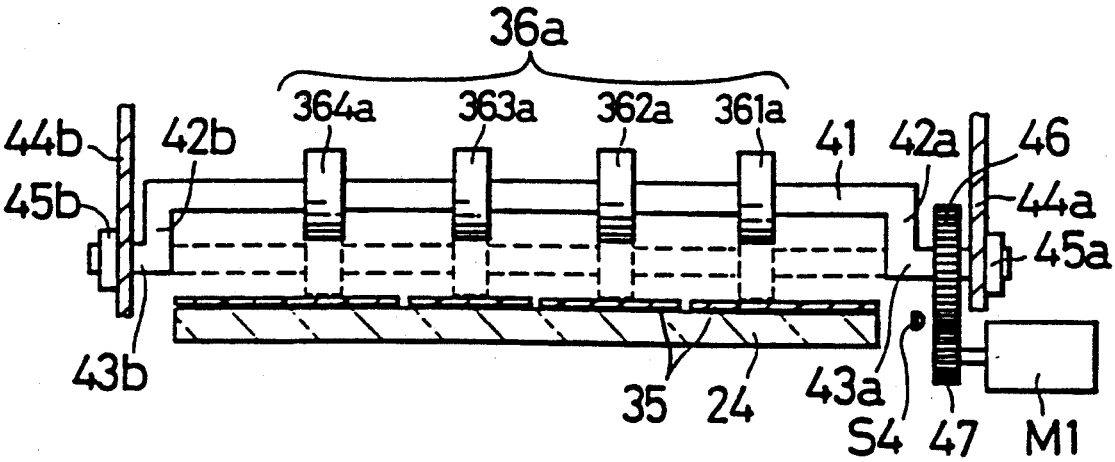
FIG. 6 is a front view schematically showing the structure of a pressure roller 36*a;*
Figure 7:
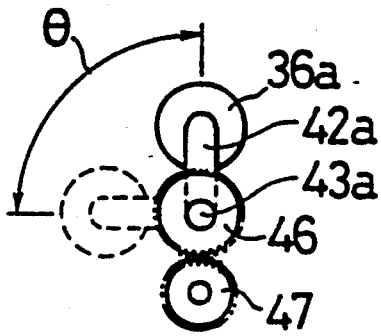
FIG. 7 is a side view schematically showing the structure of the pressure roller 36*a;*

FIG. 6 is a front view schematically showing the structure of the pressure roller 36*a*, and FIG. 7 is a side view schematically showing the structure of the same. FIG. 6 corresponds to a cross sectional view taken along line VI—VI in FIG. 3. The pressure roller 36*a* consists of a plurality of narrow-width rollers 361*a*–361*a* (four in FIG. 6) mounted rotatably on an axle 41 having an axis extending in parallel to the widthwise direction of the document D being transported. Formed integrally with the ends of the axle 41 and extending radially and outwardly from the rotational center thereof are linkage portions 42*a* and 42*b* the ends of which, opposite from the ends jointed to the axle 41, extend along said widthwise direction to form rotation shafts 43*a* and 43*b*. The rotation shafts 43*a* and 43*b* have the same axis of rotation and are rotatably mounted in side walls 44*a* and 44*b*, with bearings 45*a* and 45*b* providing respective supports. A gear wheel 46 is mounted on the rotation shaft 43*a*, the gear wheel 46 meshing with a gear wheel 47 driven by a motor M1.

Therefore, by driving the motor M1, the pressure roller 36*a* is displaced around the axis of the rotation shafts 43*a* and 43*b* by an angle $\theta$. This means that, as shown in FIG. 7, the pressure roller 36*a* can be moved vertically between an upper position indicated by solid lines and a lower position indicated by dotted lines. When the pressure roller 36*a* is moved to the upper position, the pressure is released from the belts 35. On the other hand, when the pressure roller 36*a* is moved to the lower position, the pressure is applied to the belts 35. In this embodiment, the angular displacement $\theta$ is fixed, which means that the pressure applied to the belt 35 by the pressure roller 36*a* can be changed in two steps. It is also possible to adjust the pressure by appropriately setting the length of the linkage portions 42*a* and 42*b*.

In the vicinity of the pressure roller 36*a* there is disposed a roller position detector S4 comprising, for example, an optical sensor or the like. The roller position detector S4 detects the positioning of the pressure roller 36*a*, i.e., in the upper or in the lower position, based on the amount of angular displacement of the gear wheel 46 or on other parameters.

The pressure roller 36*b*has the same construction as that of the pressure roller 36*a* and can be controlled so as to change its pressure applied to the belts 35 in the same manner. It will be appreciated that the construction for vertically moving the pressure rollers 36*a* and 36*b* in order to control the pressure applied to the belts is not limited to the one described in connection with this embodiment.

The document D fed from the document loading tray 25, as described above, is transported along the surface of the transparent plate 24 while being pressed by the belt 35, until the document scanning position 24*a* where the leading edge thereof contacts a protruding stop member 47 disposed at the downstream end of the transparent plate 24 in the document transporting direction 26.

In this embodiment, the positioning of the movable pressure rollers 36*a* and 36*b*, i.e., the respective pressures applied to the belts are controlled individually according to the size of the transported document D. FIG. 8 is a diagram explaining the operation for positioning the pressure rollers 36*a*–36*e* in this embodiment. In FIG. 8, a document to be fed first is designated by reference numeral D1 and a document to be fed subsequently to the first one is designated by D2. When the size of the document is to be designated, a suffix L (first size), M (second size), or S (third size) is attached to the same reference numerals.

FIG. 8(1) shows the condition in which a document D1L having a dimension L11 (first size) along the transporting direction has been transported to the document scanning position 24*a*, where the dimension L11 has the following relationship with respect to the distances W1 and W2 measured from the stop member 47 to the respective pressure rollers 36*a* and 36*b*.

$$W1 > L11 \geqq W2 \quad (4).$$

At this time, the pressure rollers 36*a* and 36*b* are both at the lower position, maintaining applied pressure. In the document feeding apparatus 21*a*, while the preceding document D1L placed on the scanning position 24*a* is being scanned as described hereinafter, the succeeding document D2L is preliminarily fed to a standby position immediately before the trailing edge of the preceding document D1L, which operation is known as preliminary feeding. In FIG. 8(1), all the pressure rollers 36a-36e apply pressure to press the belt 35; therefore, on the downstream side from the upstream end pressure roller 36a in the transporting direction, the belt 35 is pressed against the transparent plate 24 with the document D1L interposed therebetween. This allows the succeeding document D2L to be preliminarily fed to a standby position 24b where the leading edge thereof contacts the pressure roller 36a. Feeding further downstream of the standby position 24b will not be carried out since it would cause the leading edge of the document D2L to be bent or jammed. Therefore, the distance L13 between the preceding document D1L and the succeeding document D2L on standby is obtained by subtracting the dimension L11 from the distance W1, and the distance W1 is the distance that the succeeding document D2 needs to travel from the standby position 24b to the scanning position 24a after the scanning of the preceding document D1L is completed.

FIG. 8(2) shows the condition in which a document D1M having a dimension L21 (second size) along the transporting direction has been transported to the document scanning position 24a, where the dimension L21 has the following relationship with respect to the distances W2 and W3 measured from the stop member 47 to the respective pressure rollers 36b and 36c.

$$W2 > L21 \geqq W3 \quad (5).$$

When the size of the supplied document D1 is determined as the second size, the pressure roller 36a at the upstream end with respect to the transporting direction is moved to the upper position to release its pressure from the belt 35. As a result, the document D1M is transported to the scanning position 24a while being pressed by the remaining rollers 36b-36e. Since the pressure of the pressure roller 36a is released, a clearance is created between the belts 35 and the transparent plate 24 on the upstream side of the adjacent pressure roller 36b, allowing the succeeding document D2M to be preliminarily fed to a standby position 24b where the leading edge thereof contacts the pressure roller 36b. Therefore, the distance L23 between the preceding document D1M and the succeeding document D2M on standby is obtained by subtracting the dimension L21 from the distance W2 and is thus determined according to the dimension L21.

The distance L22 over which the succeeding document D2M is transported on the transparent plate 24 to the standby position 24b is sufficiently greater than the transport distance L12 provided in the case of the first size L11, since the pressure roller 36a is controlled so as to release its pressure. As a result, the distance that the succeeding document D2M needs to travel from the standby position 24b to the scanning position 24a after the scanning of the preceding document D1M is completed is equal to the distance W2, which is sufficiently shorter than the distance W1 provided in the case of the first size L11. When transporting the succeeding document D2M to the scanning position 24a, the pressure roller 36a is moved to the lower position so that the transporting force of the belts 35 is sufficiently transmitted to the document D2M. After the document D2M has been transported to the scanning position 24a, the pressure roller 36a is moved again to the upper position according to the size of the document D2M.

FIG. 8(3) shows the condition in which a document D1S having a dimension L31 (third dimension) along the transporting direction has been transported to the document scanning position 24a, where the dimension L31 has the following relationship with respect to the distance W3 from the stop member 47 to the pressure roller 36c.

$$W3 > L31 \quad (6).$$

When the size of the supplied document D1 is determined as the third size, the two pressure rollers 36a and 36b on the upper stream side with respect to the transporting direction are moved to the upper position to release their pressures from the belt 35. As a result, the document D1S is transported to the scanning position 24a while being pressed by the pressure rollers 36c-36e, leaving a clearance between the belt 35 and the transparent plate 24 upstream of the pressure roller 36c and thus allowing the succeeding document D2S to be preliminarily fed to a standby position 24b where the leading edge thereof contacts the pressure roller 36c. Accordingly, the distance L33 between the preceding document D1S and the succeeding document D2S on standby is obtained by subtracting the dimension L31 from the distance W3 and is thus determined according to the dimension L31.

The distance L32 over which the succeeding document D2S is transported on the transparent plate 24 to the standby position 24b is sufficiently greater than the transport distance L22 provided in the case of the second size L21, since the pressure rollers 36a and 36b are controlled so as to release their pressures. As a result, the distance that the succeeding document D2S needs to travel from the standby position 24b to the scanning position 24a after the scanning of the preceding document D1S is completed is equal to the distance W3, which is sufficiently shorter than the distance provided in the case of the first size L11 or in the case of the second size L21. When transporting the succeeding document D2S to the scanning position 24a, the pressure roller 36a or 36b is moved to the lower position so that the transporting force of the belt 35 is sufficiently transmitted to the document D2S. After the document D2S has been transported to the scanning position 24a, the pressure roller 36a or 36b is moved again to the upper position according to the size of the document D2S.

In the prior art construction, the transport distance to the standby position remains unchanged even when the document size is changed. On the other hand, according to the present embodiment, since the pressure rollers are controlled in the sequence in which they are arranged in such a manner as to release pressure in accordance with the reduction in the document size measured along the transporting direction, the succeeding document can be preliminarily fed to a standby position close enough to but not so close as to contact the preceding document. This serves to shorten the distance that the succeeding document, preliminarily fed to the standby position according to the reduction in said size, needs to travel to reach the scanning position. As a result, the total time needed to sequentially transport a plurality of documents to the scanning position can be reduced markedly.

Referring back to FIG. 3, an optical scanning means 48 is disposed inwardly of the transparent plate 24. The document D transported to the scanning position 24a as described above is optically scanned by the optical scanning means 48 for exposure of the presented document image.

After completion of the exposure process, a solenoid SOL (not shown) or the like is actuated to retract the protruding stop member 47 as indicated by dotted lines in FIG. 3, thereby opening a transport path 49 leading from the scanning position 24*a* toward the downstream side in the transporting direction. As the transport path 49 is opened, the belt 35 is restarted to rotate clockwise for transportation into the transport path 49 of the document D that has been scanned. At the same time, the succeeding document D2 that has been fed for standby at the standby position 24*b* is now transported along the transporting direction 26 toward the scanning position 24*a*. At this time, the pressure roller 36*a* or 36*b* that has been controlled so as to release pressure according to the document size, as described above, is moved to the lower position so that the transport force of the belt 35 is sufficiently transmitted to the document D2. When the succeeding document D2 has been transported to the scanning position 24*a*, the pressure of the pressure roller 36*a* or 36*b* is again released from the belt 35 according to the size of the thus transported document D2, as described above, so that a clearance is created to provide a standby position for a further succeeding document D3. The succeeding document D3 is then preliminarily transported to the standby position.

In the meantime, the document D directed into the transport path 49 is further transported by means of transport rollers 50 and 51 and is discharged onto a document exit tray 52. On the transport path 49 and adjacent to the stop member 47, there is disposed a document discharge detector S5 consisting for example of a light emitting element S5*a* and a light receiving element S5*b*. The discharge detector S5 monitors the transporting condition of the document D being discharged from the scanning position 24*a* into the transport path 49, to check whether or not jamming occurs in the transport path. When the trailing edge of the document D being transported is detected by the discharge detector S5, the solenoid SOL is controlled so as to move the stop member 47 back to the position protruding above the transparent plate 24. As a result, the document D2 that follows the document D1 being discharged is properly stopped at the scanning position 24*a* and is prevented from being discharged into the transport path 49.

Also, on the transport path 49 and adjacent to the document exit tray 52, there is disposed a document exit detector S6 consisting for example of a light emitting element S6*a* and a light receiving element S6*b*. The exit detector S6 monitors the transporting condition of the document D passed through the transport path 49 and determines whether the document D has properly been discharged onto the document exit tray 52.

Thus, the documents D stacked on the document loading tray 25 are successively fed to the document scanning position 24*a* and discharged onto the document exit tray 52 after exposure.

Next, referring to FIG. 4, the internal construction of the copying machine 22 is briefly described. The optical scanning means 48 comprises: a first moving unit containing a light source 53, such as a halogen lamp, and a reflecting mirror 54; a second moving unit 58 containing reflecting mirrors 56 and 57; a zoom lens 59; and a reflecting mirror 60. The document D with its image facing the scanning position 24*a* is subjected to light from the light source 53 while the first moving unit 55 reciprocates along the direction indicated by arrow 61, thereby optically scanning the document D for exposure. While the first moving unit 55 is moving, the second moving unit 58 moves in the same direction at half the traveling speed of the first moving unit 55, so that the light path length of the light reflected from the document D is maintained constant.

The light reflected from the document D is focused onto a photoreceptor 63 rotating in arrow direction 62. The photoreceptor 63 is of a right circular cylindrical shape having an axis perpendicular with respect to FIG. 4. An electrostatic latent image corresponding to the thus scanned and focused document image is formed on the outer circumferential surface of the photoreceptor 63 which has previously been charged by a charge corona discharger 64. The electrostatic latent image is then developed into a toner image by means of a developing unit 65 and is transferred onto one side of recording paper P by means of a transfer corona discharger 66. Prior to this process, the recording paper P fed from a paper cassette 67 has been transported to a transfer station 70 by means of a transport means 69 which includes a pair of resist rollers 68. A power transmitting means is connected to the axle of the resist roller 68 via a clutch CLT not shown. By controlling the engagement and disengagement of the clutch CLT in relation to the transportation of the document D, it is possible to match up the timing for the resist rollers 68 to transport the recording paper P with respect to the toner image on the photoreceptor 63. The recording paper P onto which the toner image has been transferred by the transfer corona discharger 66 is transported via a transport means 71 to a fixing unit 72 where the toner image is fused to the recording paper P.

When making a simplex (single-sided) copy, the recording paper, after the fusing, is discharged along a transport path 77 onto a tray 78 outside the copying machine. On the other hand, when making a duplex (two-sided) copy, the recording paper, after the fusing, is passed through a diverting means 73 by which the transporting direction of the recording paper P is reversed, the recording paper P then being fed through a transport path 74 into an intermediate storing means 75 for temporary storage. The recording paper P stored in the intermediate storing means 75 is fed back to the transfer station 70 by means of a transport means 76 and the resist rollers 68 so that a toner image is transferred to the other side of the recording paper P. After the transfer, the recording paper P is transported via the transport means 71, the fixing unit 72, and the transport path 77 and is discharged onto the tray 78 outside the copying machine 22. With the copying machine 22 and the document feeding apparatus 21 thus cooperating, a simplex (single-sided) or a duplex (double-sided) copy is made on the recording paper P.

The paper cassettes 67, 79, 80 and 81 respectively hold recording paper P of different sizes, for example, and the proper size paper is selected for transportation to the transfer station 70 according to the size of the document D placed on the scanning position 24*a*.

Figure 9:
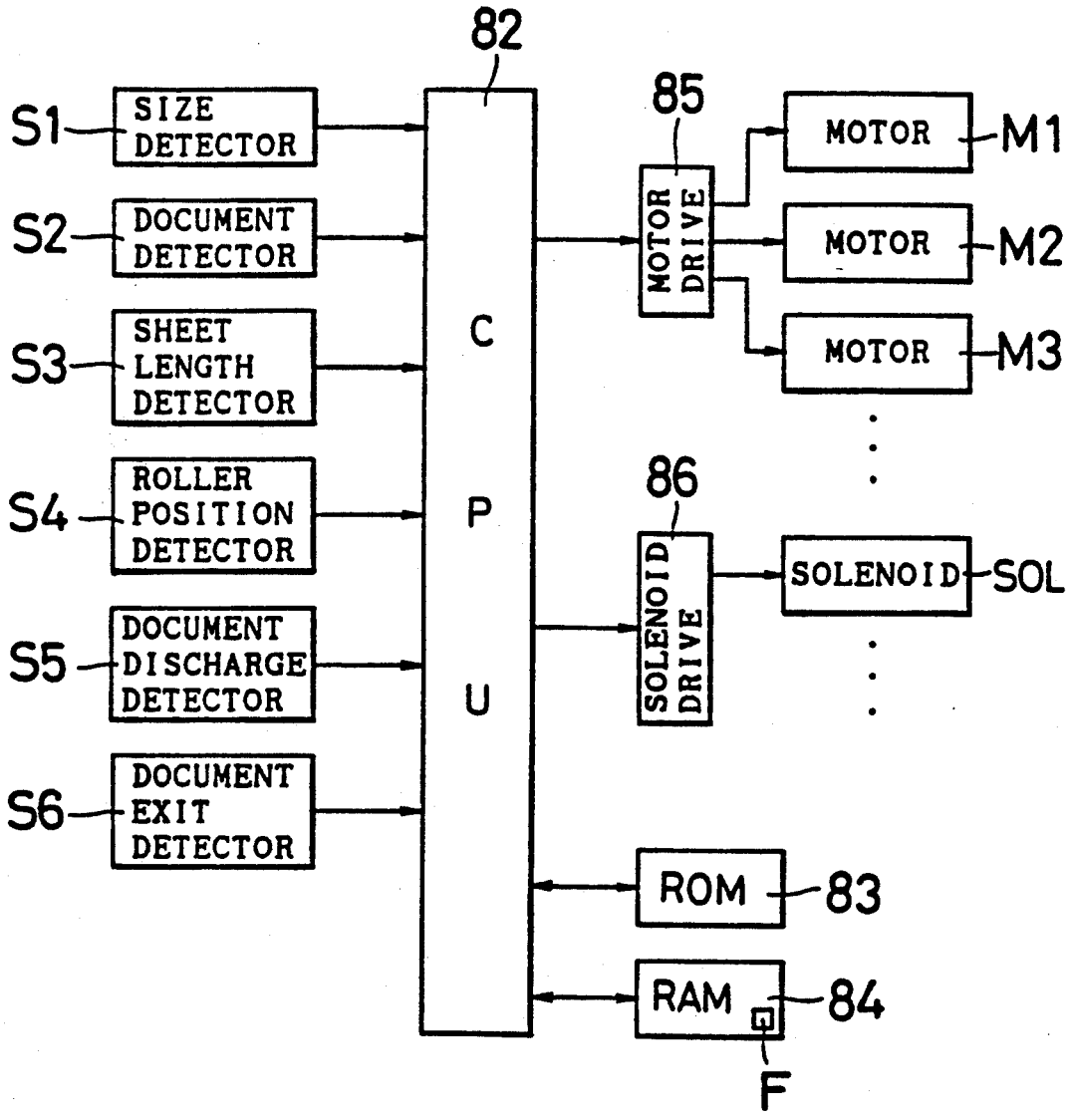
FIG. 9 is a block diagram illustrating the electrical configuration of the document feeding apparatus 21*a;*

FIG. 9 is a block diagram illustrating the electrical configuration of the document feeding apparatus 21*a*. Detection signals from the size detector S1 for detecting the size, measured along the transporting direction, of the document D being transported, the sheet length detector S3, the document detector S2 for detecting the transporting condition of the document, the document discharge detector S5, the document exit detector S6, and the roller position detector S4 for detecting the positioning of the pressure rollers 36*a* and 36*b* are supplied to a central processing unit 82 (hereinafter abbreviated as CPU) which consists, for example, of a microcomputer. The CPU 82 judges the transporting condition of the document based on the detection signals and controls the relevant circuits accordingly.

A read-only memory (ROM) 83 and a random-access memory (RAM) 84 are connected to the CPU 82. In accordance with control programs contained in the ROM 83, the CPU 82 controls copying operations by cooperating the copying machine 22 with the document feeding apparatus 21*a*. The RAM 84 is used, for example, as operating areas of counters, timers, flags, etc. which become necessary for the control of copying operations. An example of the flag area is the area of a matching flag F used to decide the matching described hereinafter between the size, measured along the transporting direction, of the document D being transported and the pressure rollers 36*a* and 36*b* to be controlled for release of pressure.

A motor driving circuit 84, a solenoid driving circuit 85, etc. are also connected to the CPU 82. These driving circuits 85, 86 are controlled in accordance with programs contained in the memories 83 and 84 based on the signals from the detectors S1–S6. Connected to the motor driving circuit 85 are various motors such as a motor M1 for moving up and down the pressure rollers 36*a* and 36*b*, a motor M2 for rotating the rollers 33 and 34 to drive the belt 35, and a motor M3 for driving the various transport rollers. Various solenoids, including the solenoid SOL for causing the stop member 47 to protrude and retract from the surface of the transparent plate 24, are connected to the solenoid driving circuit 86.

Figure 10:
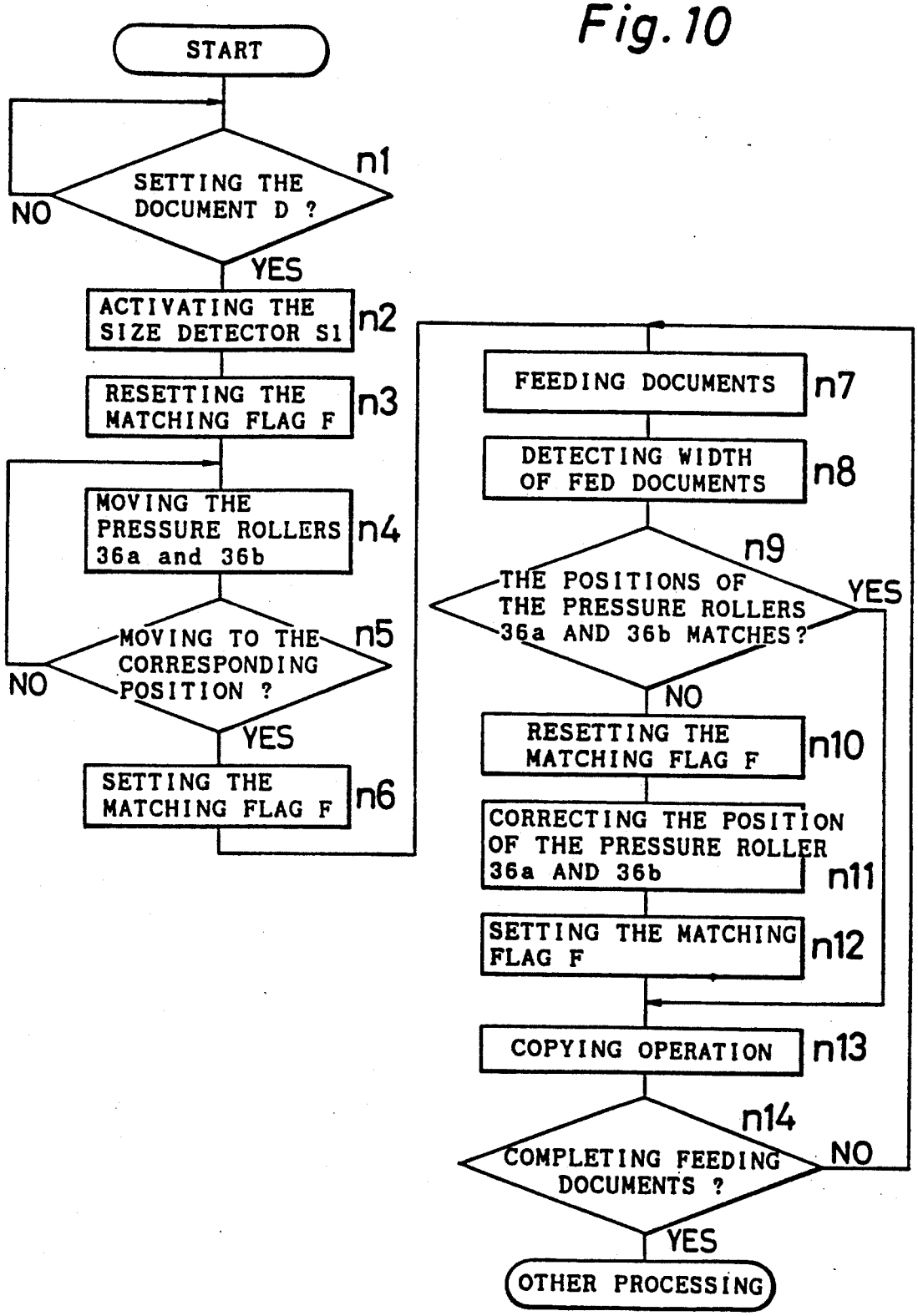
FIG. 10 is a flowchart explaining the document feeding operation in the first embodiment.

FIG. 10 is a flowchart explaining the document feeding operation in this embodiment. The program shown in FIG. 10 is initiated upon depression of the print switch when documents D to be copied are placed on the document loading tray 25. The documents D stacked on the document loading tray 25 may include sheets of different sizes such as A4 and A3.

At step n1, based on the detection result of the document detector S2, it is determined if documents D to be copied are placed on the document loading tray 25. When the presence of the documents D is detected, the size detector S1 is activated at step n2, to identify the size of the documents D by combining, for example, the detection result of the size detector S1 with the positioning limits provided by the alignment plates 27. However, the document size identified at this step is based on the size detected by the size detector S1, and all different sizes of sheets stacked together are not identified. For example, when documents of A4 size are stacked on documents of A3 size, the document size identified at this step is A3 size.

At step n3, the matching flag F is reset to enable the pressure rollers 36*a* and 36*b* for pressure control. At step n4, the size of the document D identified at step n2 is determined as one of the first to third sizes previously mentioned, in accordance with which the pressure rollers 36*a* and 36*b* are moved up or down to release or apply pressure on the belt 35. At step n5, based on the detection result of the roller position detector S4, it is determined if the pressure rollers 36*a* and 36*b* have moved to the corresponding positions. Steps n4 and n5 are repeated until the positioning is confirmed. After the positioning, at step n6, the matching flag F is set to indicate that the positioning control of the pressure rollers 36*a* and 36*b* is complete.

Thereafter, at step n7, the document D is fed from the top of the stack on the document loading tray 25. At step n8, the size of the document D being fed is detected by the sheet length detector S3. Even when the document size is different from the one previously detected by the size detector S1, this process allows the size of the document to be properly identified during transportation to the scanning position 24*a*, thus permitting proper control of the pressures applied to the belt 35 by the pressure rollers 36*a* and 36*b* as described hereinafter.

At step n9, based on the detection result of the roller position detector S4, it is determined if the previously set positions of the pressure rollers 36*a* and 36*b* match the detection result of the sheet length detector S3. If the document size and the roller positions match, the process proceeds to step n13 in which the document D transported to the scanning position 24*a* is scanned by the optical scanning means 48. On the other hand, if it is determined that the roller positions do not match the detected document size, the process proceeds to step n10 in which the matching flag F is reset once again and the pressure rollers 36*a* and 36*b* are moved for corrective positioning so as to match the size of the document D. Thereafter, at step n12, the matching flag F is set, and at step n13, a scanning operation is performed on the document D transported to the scanning position 24*a*.

The processing at steps n8–n12 is performed to correct the roller positions in order to achieve higher quality and higher speed in copying operation and may be omitted. When steps n8–n12 are omitted, the pressure rollers 36*a* and 36*b* are controlled based only on the size detected by the size detector S1.

When the scanning operation is completed, the process proceeds to step n14 in which it is decided if all the documents have been fed, based on the detection result of the document detector S2. If the decision is negative, the process returns to step n7 and the above described process is repeated, the positions of the pressure rollers 36*a* and 36*b* being corrected according to the size of each of the documents D successively fed. On the other hand, if the decision at step n14 is affirmative, other processing is performed, for example, to stop the operation of the copying machine 22 and document feeding apparatus 21*a*.

Thus, according to the present embodiment, when sequentially feeding a plurality of document sheets to the scanning position, a plurality of pressure rollers on the upper stream side with respect to the document transporting direction are controlled by a simple mechanism in such a manner as to release their respective pressures from the belt according to the size of the preceding document. This allows the succeeding document to be preliminarily fed to a standby position as close as possible to the preceding document. As a result, the distance the succeeding document that follows the preceding document needs to travel to reach the scanning position, and hence the length of time needed to transport the document to that position, is markedly reduced, which eventually leads to a marked reduction in the total time needed to sequentially transport a plurality of documents to the scanning position. Accordingly, the copying time in the copying machine can be reduced markedly.

The above embodiment has been described in connection with the construction of an electrostatic image transfer copying machine, but it will be appreciated that this embodiment can also be applied to a construction in which copying is made, for example, on photosensitized recording paper.

Also, the number of pressure rollers controlled for pressure release is not limited to two but may be more than two. The range of the document size that determines the combination of pressure rollers to be controlled is decided according to the number of pressure rollers that can be controlled.

EMBODIMENT 2

Figure 11:
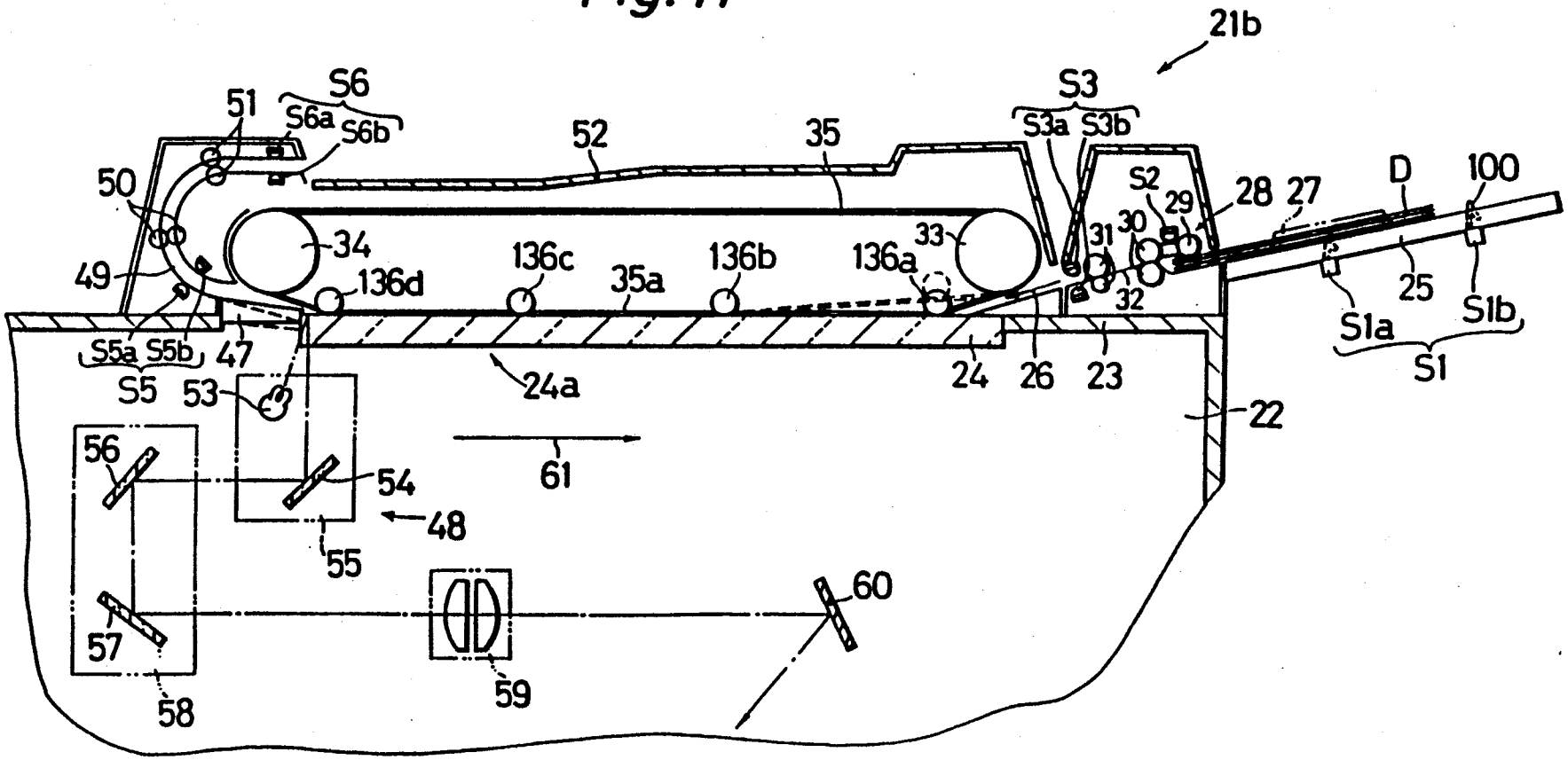
FIG. 11 is a cross sectional view schematically showing the structure of a document feeding apparatus 21*b* in a second embodiment of the invention.
Figure 12:
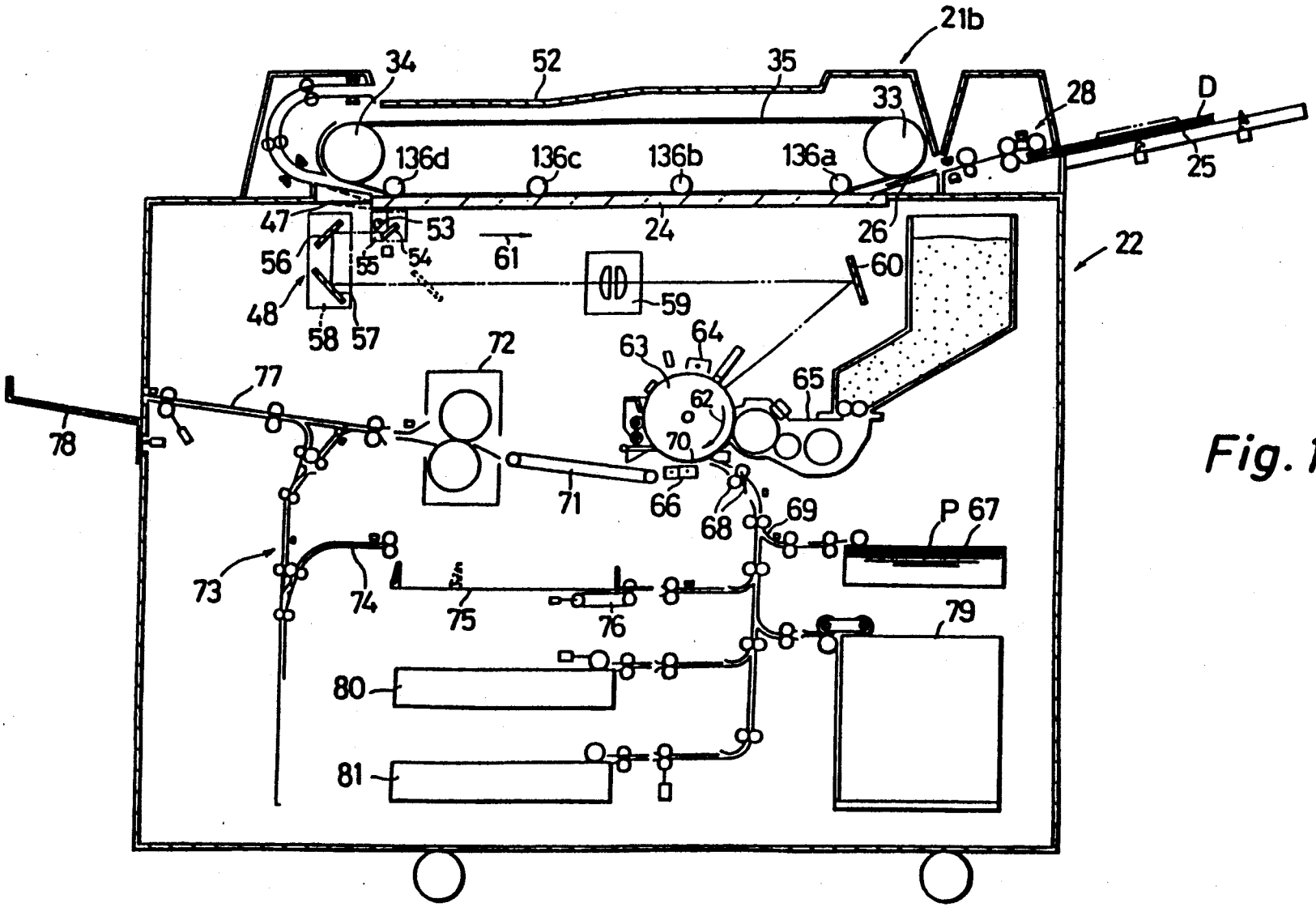
FIG. 12 is a cross sectional view schematically showing the structure of an electrostatic copying machine 22 equipped with the document feeding apparatus 21*b;*

FIG. 11 is a cross sectional view schematically showing the structure of a document feeding apparatus 21*b* in a second embodiment of the invention, and FIG. 12 is a cross sectional view schematically showing the structure of an electrostatic image transfer copying machine 22 equipped with the document feeding apparatus 21*b*.

The document feeding apparatus 21*b* is analogous in construction to the foregoing document feeding apparatus 21*a*, and therefore, corresponding parts are designated by the same reference numerals. The feature of this embodiment is that four pressure rollers 136*a*–136*d* are disposed with the pressure roller 136*a*, disposed at the upstream end with respect to the transporting direction 26 of the document D, being movable in a vertical direction.

In this embodiment also, a pair of rollers 33 and 34 each having an axis extending in the widthwise direction of the document D are disposed above the transparent plate 24 in such a manner as to be spaced apart along the document transporting direction 26. An endless belt 35 is passed around the pair of rollers 33 and 34. On the inside of the belt 35 and adjacent to the lower taut portion 35*a* thereof are disposed a plurality of pressure rollers 136*a*–136*d* (four in this embodiment) spaced apart in this order along the transporting direction 26. The pressure rollers 136*a*–136*d* apply pressure to press the belt 35 against the transparent plate 24, thus keeping the belt 35 from slacking while preventing the document D fed between the belt 35 and the transparent plate 24 from lifting.

In this embodiment, the pressures applied to the belts by the respective pressure rollers 136*a*–136*d* are controlled individually. In particular, in FIG. 11, the pressure of the pressure roller 136*a* disposed at the upstream end with respect to the document transporting direction 26 is controlled in multiple stages according to the size of the supplied document D measured in the transporting direction 26. On the other hand, the other pressure rollers 136*b*–136*d* are controlled to apply constant pressure to the belt 35 regardless of the size of the supplied document D.

The pressure rollers 136*b*–136*d* each have the same construction as that of the pressure roller 36*c* shown in FIG. 5 in the foregoing embodiment. Thus, the pressure rollers 136*b*–136*d* apply constant pressure to press the belt 35 against the transparent plate 24.

The pressure roller 136*a* has the same construction as that of the pressure roller 36*a* shown in FIGS. 6 and 7 in the foregoing embodiment.

In this embodiment, the amount of displacement $\theta$ can be set by controlling the driving time of the motor M1, thus allowing the pressure applied to the belt 35 by the pressure roller 136*a* to be varied in multiple stages. Also, the pressure can be adjusted by appropriately setting the length of the linkage portions 42*a* and 42*b*.

The position of the vertically movable pressure roller 136*a* of this embodiment, and hence the pressure applied of the supplied document D measured along the transporting direction 26. Therefore, a document succeeding the document currently being scanned at the scanning position 24*a* for exposure as described hereinafter can be preliminarily fed to a standby position 124*b* on the transparent plate 24 so that the succeeding document is positioned as close as possible to the preceding document.

Figure 13:
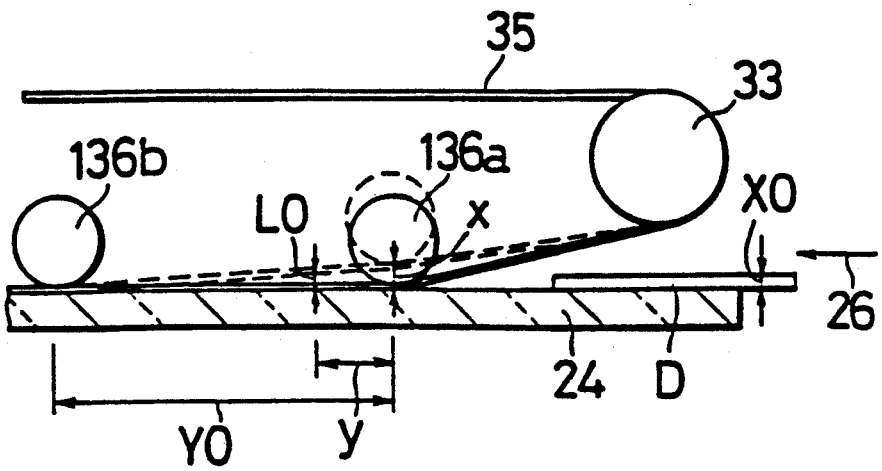
FIG. 13 is a principle drawing explaining a standby position 124*b* to be set in the second embodiment.

FIG. 13 is a principle diagram explaining the standby position 124*b* to be set in this embodiment. In FIG. 13, it is assumed for convenience sake that the pressure roller 136*a* moves in vertical direction (up and down in FIG. 13) and that a clearance LO is not formed between the belt 35 and the transparent plate 24 when the pressure rollers 136*a*–136*d* are positioned in the lower position. Also, the standby position 124*b* refers to the position at which the clearance LO formed between the belt 35 and the transparent plate 24 with the pressure roller 136*a* moved up decreases to match the thickness XO of the document D fed therebetween so that the leading edge of the document D is allowed to reach up to that position. As a result, since the rotation of the belt 35 is stopped during the scanning of the preceding document, only the transporting force of the document feeding means 28 acts on the document D to be fed to the standby position 124*b* and thus the document D is not transported further downstream of the standby position 124*b* to prevent the leading edge of the document D from being bent or jammed.

With reference to FIG. 13, the relationship between the elevation amount x of the pressure roller 136*a* and the displacement amount y of the standby position 124*b* is roughly expressed by the following equation.

$$y = Y0 - X0 \cdot Y0/x \qquad (7).$$

X0: Thickness of document D

Y0: Spacing between the pressure rollers 136*a* and 136*b*.

Figure 14:
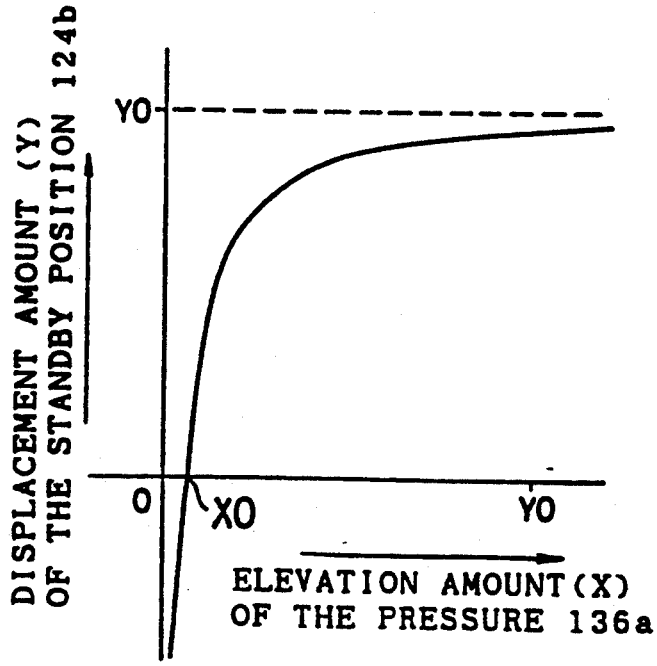
FIG. 14 is a diagram showing the relationship between the elevation amount x of a pressure roller 136*a* and the displacement amount y of the standby position 124*b;*

FIG. 14 shows the characteristic of the above equation (7). As is apparent from FIG. 14, the standby position 124*b* is displaced further downstream in the document transporting direction 26 as the pressure roller 136*a* is elevated. Further, in FIG. 14, the displacement amount of the standby position 124*b* varies in a hyperbolic manner with the elevation of the pressure roller 136*a*, but the characteristic of the displacement amount y of the standby position 124*b* can be appropriately set according to the construction for elevation.

FIG. 15 is a diagram explaining the operation for positioning the pressure rollers 136*a*–136*d* in this embodiment. In FIG. 15, a document to be fed first is designated by reference numeral D1 and a document to be fed subsequently to the first one is designated by D2.

FIG. 15(1) shows the condition in which a document D1 having a dimension L111 along the transporting direction has been transported to the document scanning position 24*a*, where the dimension L111 has the following relationship with respect to the distance W11 between the stop member 47 and the pressure roller 136*a*.

$$W11 > L111 \qquad (8)$$

However, the distance W11 is only slightly greater than the dimension L111. At this time, the pressure roller 136a is at the lower position, maintaining its pressure. Therefore, the document D1 transported to the scanning position 24a is pressed against the transparent plate 24 by means of the pressure rollers 136a–136d, so that the succeeding document D2 is preliminarily fed to the standby position 124b where the leading edge thereof contacts the pressure roller 136a. Therefore, the distance L113 between the preceding document D1 and the succeeding document D2 is approximately equal to the difference between the dimension L111 and the distance W11, and the distance that the succeeding document D2 needs to travel from the standby position 124b to the scanning position 24a after completion of the scanning of the preceding document D1 is equal to the distance W11.

FIG. 15(2) shows the condition in which a document D1 having a dimension L121 along the document transporting direction has been transported to the document scanning position 24a, where the dimension L121 has the following relationship with respect to the distance W12 between the stop member 47 and the pressure roller 136b.

$$L111 > L121 > W12 \quad (9)$$

When it is determined that the size of the supplied document D1 satisfies the above relationship (9), the pressure roller 136a at the upstream end with respect to the document transporting direction is moved to an upper position to release its pressure applied to the belt 35. Accordingly, when the document D1 has been transported to the scanning position 24a by being pressed by the remaining pressure rollers 136b–136d while the pressure roller 136a is controlled to release its pressure, a clearance is formed between the belt 35 and the transparent plate 24 downstream of the pressure roller 136a in the document transporting direction. The clearance is determined by the amount of elevation of the pressure roller 136a as shown in the foregoing FIGS. 13 and 14, and therefore, the standby position 124b for the preliminary feeding of the succeeding document D2 is displaced further downstream in the transporting direction as the pressure roller 136a is elevated. In FIG. 15(2), the amount of elevation of the pressure roller 136a is determined so that the distance L123 between the document D2 preliminarily fed to the standby position 124b and the preceding document D1 placed on the scanning position 24a is approximately equal to the distance L113 between the documents D1 and D2 provided in the case of the foregoing dimension L111.

The distance L123 does not necessarily have to be exactly equal to the distance L113 for the dimension L111, but should only be determined so that the succeeding document D2 can be placed close to the preceding document D1 but not so close as to hit it.

Since the pressure roller 136a is controlled so as to release its pressure, the transport distance L122 on the transparent plate 24 that the following document D2 travels to reach the standby position 124b is sufficiently greater than the transport distance L112 provided in the case of the foregoing dimension L111. As a result, the distance that the succeeding document D2 needs to travel from the standby position 124b to the scanning position 24a after completion of the scanning of the preceding document D1 is equal to the sum of the dimension L121 and the distance L123, which is substantially shorter than the distance W11 needed in the case of the dimension L111. When transporting the succeeding document D2 to the scanning position 24a, the pressure roller 136a is moved down to the lower position so that the transporting force of the belt 35 is sufficiently transmitted to the document D2. After the document D2 has been transported to the scanning position 24a, the pressure roller 136a is moved back to the upper position according to the size of the document D2.

Further, FIG. 15(3) shows the condition in which a document D1 having a dimension L131 along the document transporting direction has been transported to the document scanning position 24a, where the dimension L131 has the following relationship with respect to the distance W12 between the stop member 47 and the pressure roller 136b.

$$W12 > L131 \quad (10).$$

When it is determined that the size of the supplied document D1 satisfies the above relationship (10), the pressure roller 136a at the upstream end with respect to the transporting direction is moved to the uppermost position. As a result, the document D1 is transported to the scanning position 24a by being pressed by the pressure rollers 136b–136d, leaving a sufficient clearance between the belt 35 and the transparent plate 24 along the path from the pressure roller 136a to the pressure roller 136b. Therefore, the succeeding document D2 can be preliminarily fed to the standby position 124b where the leading edge thereof contacts the pressure roller 136b. The distance L133 between the preceding document D1 and the succeeding document D2 on a standby is equal to the difference between the distance W12 and the dimension L131, which means that the distance L133 is determined by the dimension L131.

Also, as the pressure roller 136a is controlled to release its pressure, the transport distance L132 on the transparent plate 24 over which the succeeding document D2 is preliminarily fed to the standby position 124b is sufficiently greater than the distance L122 provided in the case of the foregoing dimension L121. As a result, the distance that the succeeding document D2 needs to travel from the standby position 124b to the scanning position 24a after completion of the scanning of the preceding document D1 is equal to the distance W12, which is substantially short as compared with the distance needed in the case of the foregoing dimension L111 or L121. When transporting the succeeding document D2 to the scanning position 24a, the pressure roller 136a is moved down to the lower position so that the transporting force of the belt 35 is sufficiently transmitted to the document D2. After the document D2 has been transported to the scanning position 24a, the pressure roller 136a is moved back to the upper position according to the size of the document D2.

To recapitulate, the pressure roller 136a at the upstream end with respect to the document transporting direction is moved upward in correspondence with the reduction in the size of the document D1 measured along the transporting direction 26 thereof. That is, as the document size is reduced, the pressure roller 136a is moved further away from the transparent plate 24, and as the document size increases, it is moved closer to the transparent plate 24. As a result, the document D2 that follows the preceding document D1 can be preliminarily fed to the standby position sufficiently close to the preceding document D1 positioned stationary for exposure. In the prior art construction, the transport distance to the standby position remains unchanged even when the document size is changed. According to the present embodiment, however, the transport distance can be set according to the document size, which serves to markedly reduce the distance that the succeeding document D2 needs to travel from the standby position to the scanning position after the preceding document D1. This results in a marked reduction in the total time needed to sequentially transport a plurality of documents to the scanning position.

The distances W11 and W12 are so set as to accommodate various document sizes measured along the document transporting direction 26, such as A3 size, B5 size, etc., within the ranges provided by the respective expressions (8) to (10).

Figure 16:
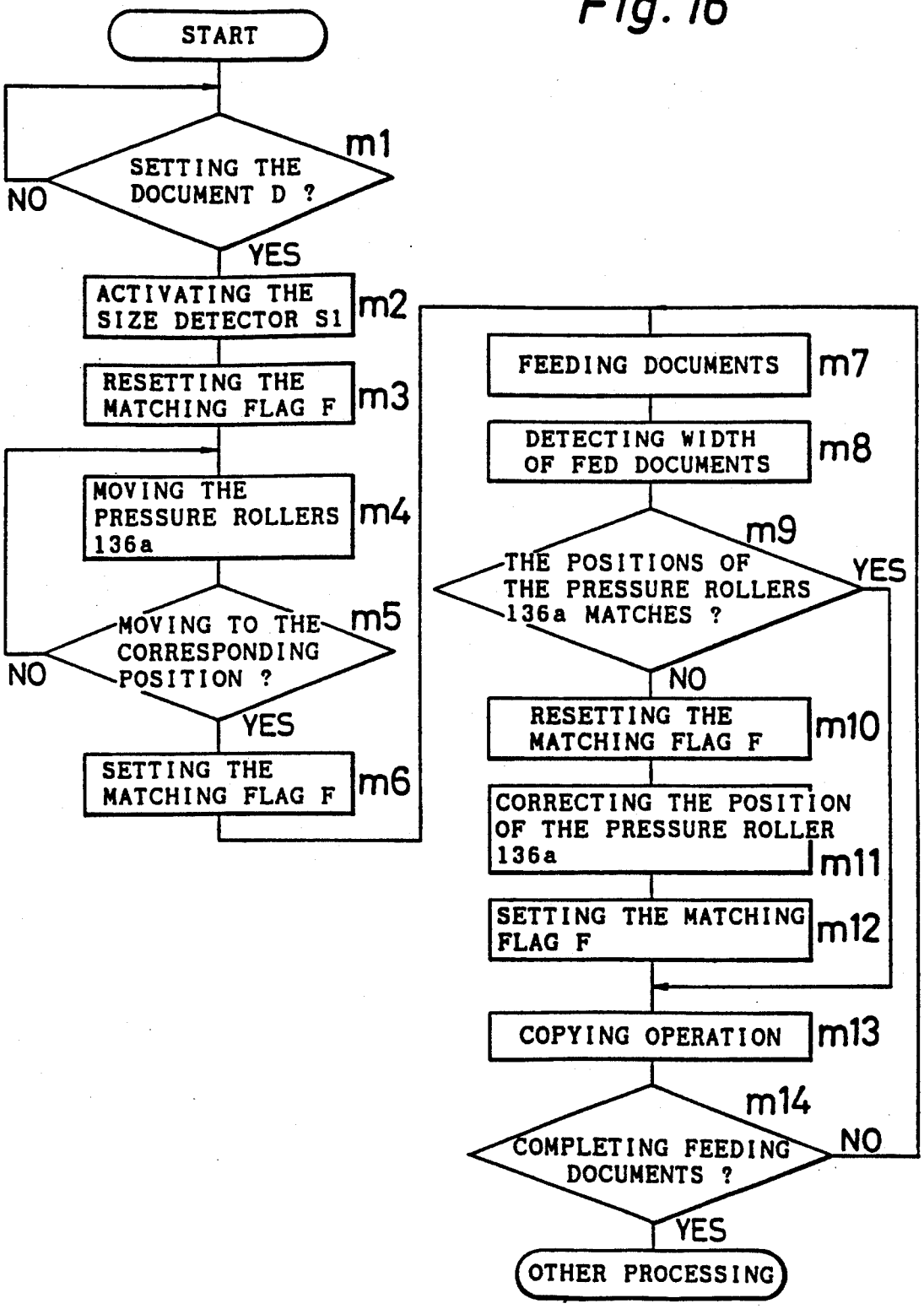
FIG. 16 is a flowchart explaining the document feeding operation in the second embodiment.

FIG. 16 is a flowchart explaining the document feeding operation in this embodiment. The program shown in FIG. 16 is initiated upon depression of the print switch when documents D to be copied are placed on the document loading tray 25. The documents D stacked on the document loading tray 25 may include sheets of different sizes such as A4 and A3.

At step m1, based on the detection result of the document detector S2, it is determined if documents D to be copied are placed on the document loading tray 25. When the presence of the documents D is detected, the size detector S1 is activated at step m2, to identify the size of the documents D by combining, for example, the detection result of the size detector S1 with the positioning limits provided by the alignment plates 27. However, the document size identified at this step is based on the size detected by the size detector S1, and all different sizes of sheets stacked together are not identified. For example, when documents of A4 size are stacked on documents of A3 size, the document size identified at this step is A3 size.

At step m3, the matching flag F is reset to enable the pressure roller 136a for pressure control. At step m4, in accordance with the size of the documents D identified at step m2, the pressure roller 136a is moved up or down to control the pressure on the belt 35. At step m5, based on the detection result of the roller position detector S4, it is determined if the pressure roller 136a has moved to the corresponding position. Steps m4 and m5 are repeated until the positioning is confirmed. After the positioning, at step m6, the matching flag F is set to indicate that the positioning control of the pressure roller 136a is complete.

Thereafter, at step m7, the document D is fed from the top of the stack on the document loading tray 25. At step m8, the size of the document D being fed is detected by the sheet length detector S3. Even if the document size is different from the one previously detected by the size detector S1, this process allows the size of the document to be properly identified during transportation to the scanning position 24a, thus permitting proper control of the pressure applied to the belt 35 by the pressure roller 136a as described hereinafter.

At step m9, based on the detection result of the roller position detector S4, it is determined if the previously set position of the pressure roller 136a matches the detection result of the sheet length detector S3. If the document size and the roller position match, the process proceeds to step m13 in which the document D transported to the scanning position 24a is scanned by the optical scanning means 48. On the other hand, if it is determined that the roller position does not match the detected document size, the process proceeds to step m10 in which the matching flag F is reset once again and the pressure roller 136a is moved for corrective positioning so as to match the size of the document D. Thereafter, at step m12, the matching flag F is set, and at step m13, a scanning operation is performed on the document D transported to the scanning position 24a.

The processing at steps m8–m12 is performed to correct the roller position in order to achieve higher quality and higher speed in copying operation and may be omitted. When steps m8–m12 are omitted, the pressure roller 136a is controlled based only on the size detected by the size detector S1.

When the scanning operation is completed, the process proceeds to step m14 in which it is decided if all the documents have been fed, based on the detection result of the document detector S2. If the decision is negative, the process returns to step m7 and the above described process is repeated, the position of the pressure roller 136a being corrected according to the size of each of the documents D sequentially fed. On the other hand, if the decision at step m14 is affirmative, other processing is performed, for example, to stop the operation of the copying machine 22 and document feeding apparatus 21.

Thus, according to the present embodiment, when sequentially feeding a plurality of document sheets to the scanning position, the pressure roller at the upstream end with respect to the document transporting direction is controlled by a simple mechanism in such a manner as to release its pressure from the belt according to the size of the preceding document. This allows the succeeding document to be preliminarily fed to a standby position as close as possible to the preceding document. As a result, the distance the succeeding document that follows the preceding document needs to travel to reach the scanning position, and hence the length of time needed to transport the document to that position, is markedly reduced, which eventually leads to a marked reduction in the total time needed to sequentially transport a plurality of documents to the scanning position. Accordingly, the copying time in the copying machine can be reduced markedly.

The above embodiment has been described in connection with the construction of an electrostatic image transfer copying machine, but it will be appreciated that this embodiment can also be applied to a construction in which copying is made, for example, on photosensitized recording paper.

EMBODIMENT 3

Figure 17:
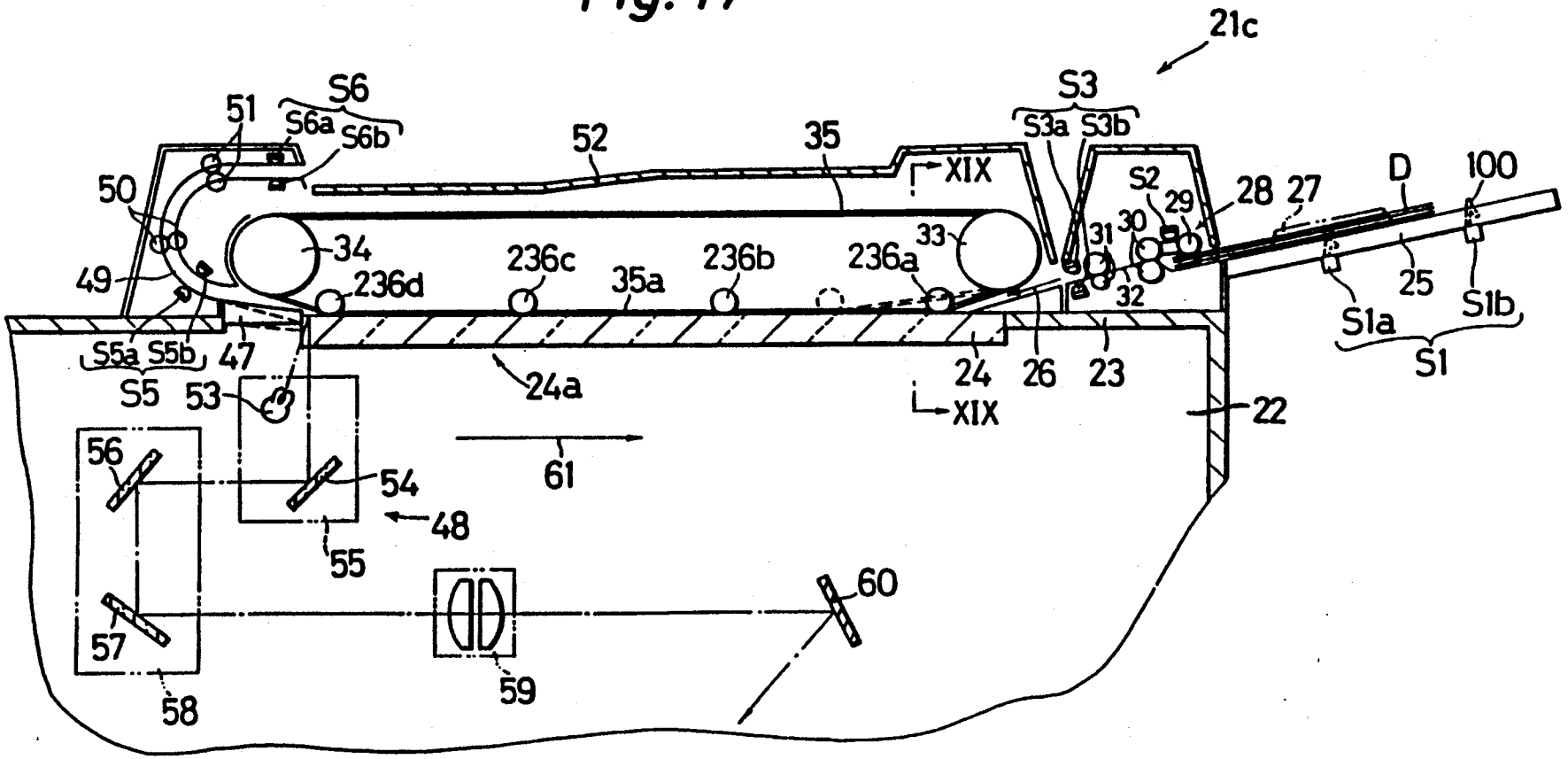
FIG. 17 is a cross sectional view schematically showing the structure of a document feeding apparatus 21*c* in a third embodiment of the invention.
Figure 18:
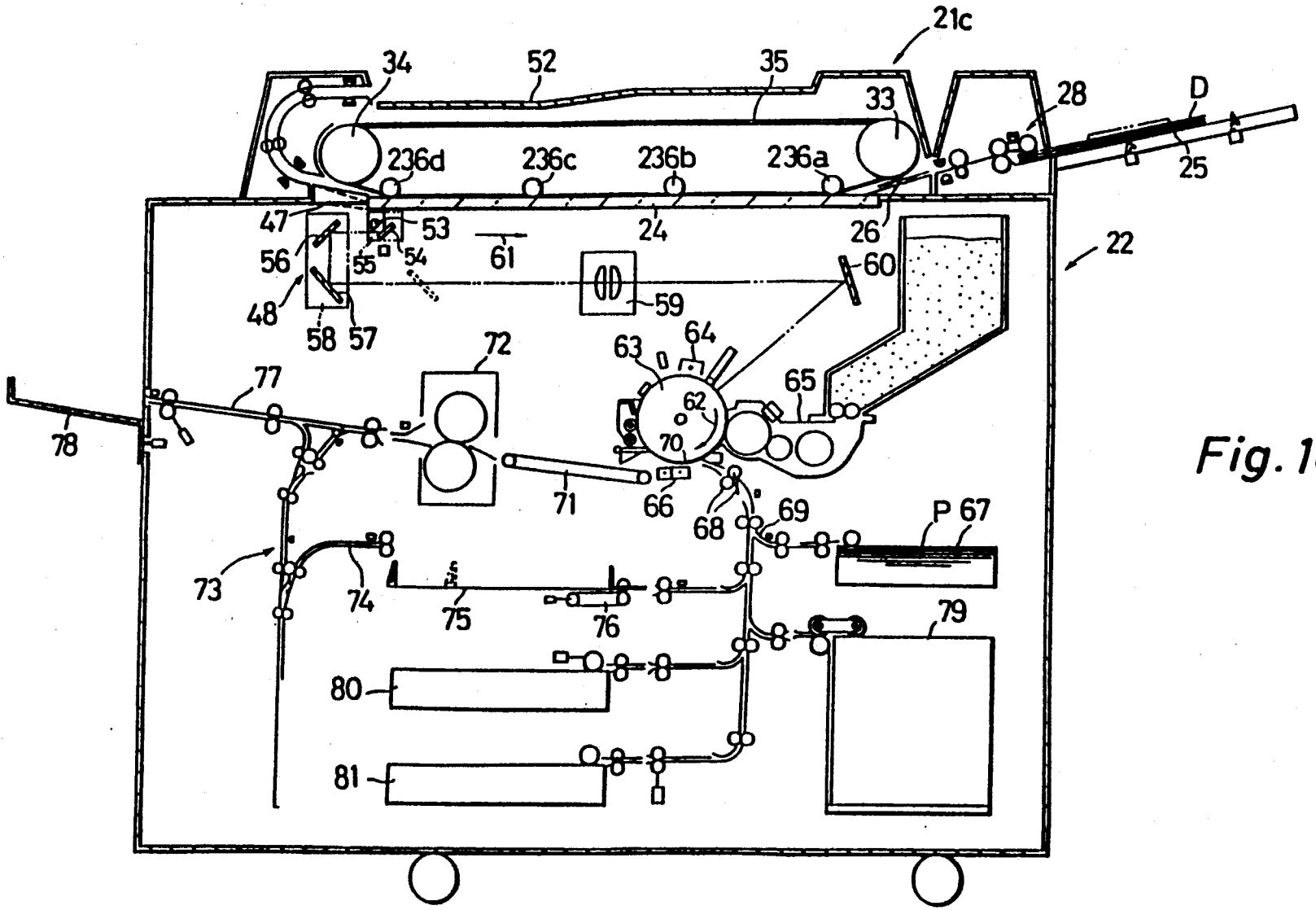
FIG. 18 is a cross sectional view schematically showing the structure of an electrostatic copying machine 22 equipped with the document feeding apparatus 21*c;*

FIG. 17 is a cross sectional view schematically showing the structure of a document feeding apparatus 21c in a third embodiment of the invention, and FIG. 18 is a cross sectional view schematically showing the structure of an electrostatic image transfer copying machine 22 equipped with the document feeding apparatus 21c.

The document feeding apparatus 21c is analogous in construction to the foregoing document feeding apparatus 21a, and therefore, corresponding parts are designated by the same reference numerals. The feature of this embodiment is that four pressure rollers 236a–236d are disposed with the pressure roller 236a, disposed at the upstream end with respect to the transporting direction 26 of the document D, being movable along the transporting direction 26.

In this embodiment also, a pair of rollers 33 and 34 each having an axis extending in the widthwise direction of the document D are disposed above the transparent plate 24 in such a manner as to be spaced apart along the document transporting direction 26. An endless belt 35 is passed around the pair of rollers 33 and 34. On the inside of the belt 35 and adjacent to the lower taut portion 35*a* thereof are disposed a plurality of pressure rollers 236*a*–236*d* (four in this embodiment) spaced apart in this order along the transporting direction 26. The pressure rollers 236*a*–236*d* apply pressure to press the belt 35 against the transparent plate 24, thus keeping the belt 35 from slacking while preventing the document D fed between the belt 35 and the transparent plate 24 from lifting.

In this embodiment, the pressure rollers 236*a*–236*d* are controlled individually. In particular, as shown in FIG. 17, the pressure roller 236*a* disposed at the upstream end with respect to the document transporting direction 26 is controlled so that its position at which to apply pressure to the belt 35 is changed in multiple steps according to the size of the supplied document D measured in the transporting direction 26. On the other hand, the other pressure rollers 236*b*–236*d* are controlled to apply pressure to the belt 35 at the same positions regardless of the size of the supplied document D.

The pressure rollers 236*b*–236*d* each have the same construction as that of the pressure roller 36*c* shown in FIG. 5 in the first embodiment. Thus, the pressure rollers 236*b*–236*d* apply pressure at the same positions to press the belt 35 against the transparent plate 24.

Figure 19:
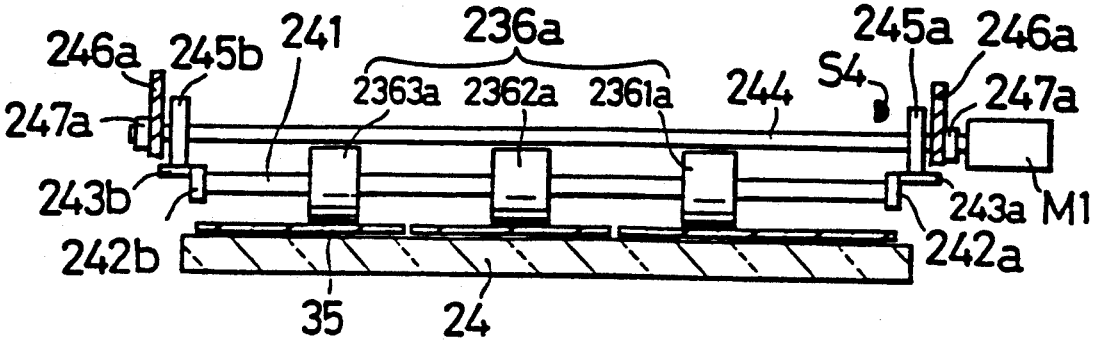
FIG. 19 is a front view schematically showing the structure of a pressure roller 236*a;*
Figure 20:
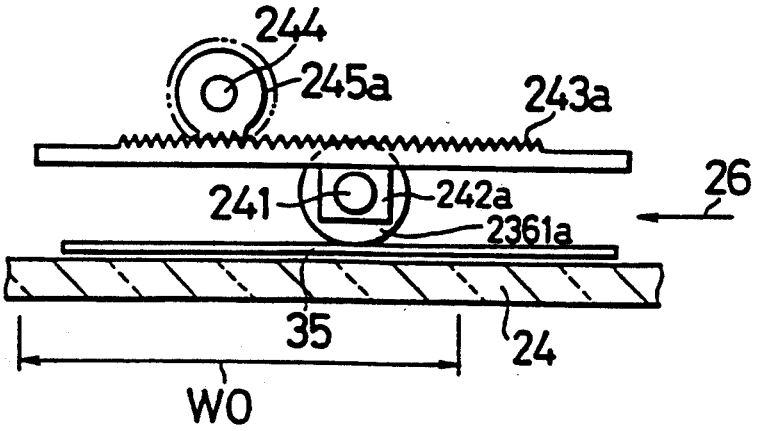
FIG. 20 is a side view schematically showing the structure of the pressure roller 236*a*.

FIG. 19 is a front view schematically showing the structure of the pressure roller 236*a*, and FIG. 20 is a side view schematically showing the structure of the same. FIG. 19 corresponds to a cross sectional view taken along line XIX—XIX in FIG. 17. The pressure roller 236*a* consists of a plurality of narrow-width rollers 2361*a*–2363*a* (three in FIG. 19) mounted rotatably on an axle 241 having an axis extending in parallel to the widthwise direction of the document D being transported. The ends of the axle 241 are supported by bearings 242*a* and 242*b* to which are connected racks 243*a* and 243*b* each extending along the document transporting direction 26 and having a toothed face facing perpendicularly upward (upward in FIG. 20). The racks 243*a* and 243*b*, respectively, are meshed with gear wheels 245*a* and 245*b* mounted on an axle 244. The gear wheels 245*a* and 245*b* have the same diameter and the same number of teeth. The ends of the axle 244 are rotatably mounted in side walls 246*a* and 246*b* disposed at both sides and are supported by bearings 247*a* and 247*b*. The axle 244 also serves as a driving shaft via which the rotational force of the motor M1 is transmitted.

Therefore, when the motor M1 is driven, the racks 243*a* and 243*b* meshing with the gear wheels 245*a* and 245*b* are moved in a horizontal direction causing the roller 236*a* connected thereto via the bearing 242*a* to move backward and forward along the document transporting direction 26 within the range WO in FIG. 20. Thus, by controlling the length of time to drive the motor M1, the location of the pressure roller 236*a* within the moving range WO, i.e. the position at which to apply its pressure to the belt 35, can be changed in multiple stages according to the size of the supplied document D.

Also disposed adjacent to the pressure roller 236*a* is a roller position detector S4 comprising, for example, an optical sensor or the like. The roller position detector S4 detects the positioning of the pressure roller 236*a*, based for example on the amount of angular displacement of the gear wheel 245*a* and the displacement amount of the rack 243*a*.

It will also be appreciated that the construction for horizontally moving the pressure roller 236*a* to change its position at which to apply pressure to the belt 35 is not limited to the one described in connection with this embodiment.

The document D fed from the document loading tray 25, as described previously, is transported along the surface of the transparent plate 24 while being pressed by the belt 35, until it reaches the scanning position 24*a* where the leading edge thereof contacts the protruding stop member 47 disposed at the downstream end of the transparent plate 24 in the document transporting direction. In this embodiment, the positioning of the movable pressure roller 236*a* is determined according to the size of the document D measured along the transporting direction 26 thereof. As a result, a document that succeeds the document currently being scanned for exposure at the scanning position 24*a* is allowed to be preliminarily fed to a standby position 224*b* on the transparent plate 24 so that the distance between the preceding and succeeding documents is substantially reduced.

Figure 21:
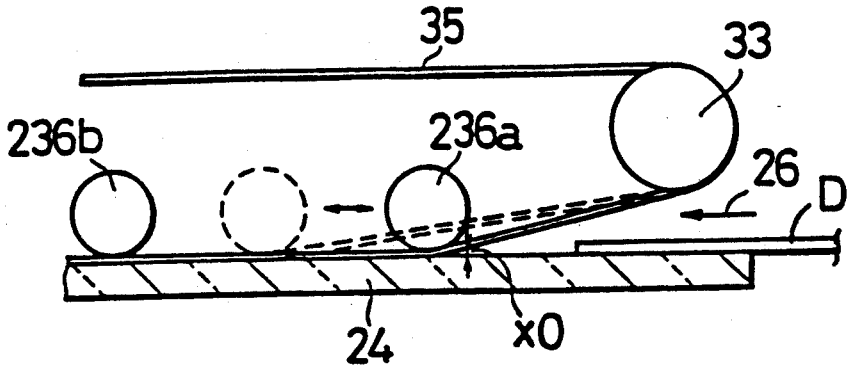
FIG. 21 is a principle diagram explaining a standby position 224*b* to be set in the third embodiment.

FIG. 21 is a principle diagram explaining the standby position 224*b* to be set in this embodiment. In FIG. 21, it is assumed for convenience sake that the pressure roller 236*a* moves backward and forward along the document transporting direction 26 and that a clearance XO is formed upstream of the upstream end pressure roller 236*a* with respect to the transporting direction 26, but not formed along the path between the pressure rollers 236*a* to 236*d* where the belt 35 are pressed against the transparent plate 24 with the document transported to the scanning position being interposed therebetween. Also, the standby position 224*b* refers to the position at which the leading edge of the document D that follows the document currently on the scanning position 24*a* reaches a point near the pressure roller 236*a*, approximately up to which point the clearance XO is formed. As a result, since the rotation of the belt 35 is stopped during the scanning of the preceding document, only the transporting force of the document feeding means 28 acts on the document D to be fed to the standby position 224*b* and thus the document D is not transported further downstream of the standby position 224*b* to prevent the leading edge of the document D from being bent or jammed.

In FIG. 21, the pressure roller 236*a* is shown as movable from a position indicated by solid lines to a position indicated by dotted lines, and the leading edge of the clearance XO moves along with this movement of the pressure roller 236*a*. This means that the standby position 224*b* for preliminary feeding of the document D also moves along the transporting direction 26 as the pressure roller 236*a* is moved in horizontal direction.

FIG. 22 is a diagram explaining the operation for positioning the pressure rollers 236*a*–236*d* in this embodiment. In FIG. 22, a document to be fed first is designated by reference numeral D1 and a document to be fed subsequently to the first one is designated by D2.

FIG. 22(1) shows the condition in which a document D1 having a dimension L211 along the transporting direction has been transported to the document scanning position 24*a*, where the dimension L211 has the following relationship with respect to the distance W21 between the stop member 47 and the pressure roller 236*a* in its home position.

$$W21 > L211 \quad (11)$$

However, the distance W21 is only slightly greater than the dimension L211. At this time, the pressure roller 136*a* stays in its home position and is not moved horizontally. As a result, the document D1 transported to the scanning position 24*a* is pressed against the transparent plate 24 by means of the pressure rollers 236*a*–236*d*, allowing the succeeding document D2 to be preliminarily fed to the standby position 224*b* where the leading edge thereof reaches the point near the pressure roller 236*a*. Therefore, the distance L213 between the preceding document D1 and the succeeding document D2 is approximately equal to the difference between the dimension L211 and the distance W21, and the distance that the following document D2 needs to travel from the standby position 224*b* to the scanning position 24*a* after completion of the scanning of the preceding document D1 is equal to the distance W21.

FIG. 22(2) shows the condition in which a document D1 having a dimension L221 along the document transporting direction has been transported to the document scanning position 24*a*, where the dimension L221 has the following relationship with respect to the distance W22 between the stop member 47 and the pressure roller 236*a*.

$$L211 > W22 > L221 \quad (12)$$

When it is determined that the size of the supplied document D1 satisfies the above relationship (12), the pressure roller 236*a* at the upstream end with respect to the document transporting direction is moved toward the downstream side in the transporting direction according to the size of the document D1. As a result, the document D1 is transported to the scanning position 24*a* by being pressed by the pressure rollers 236*a*–136*d*, and the clearance between the belt 35 and the transparent plate 24, formed upstream of the pressure roller 236*a* with respect to the transporting direction, is expanded toward the downstream side in the transporting direction. In FIG. 22(2), the amount of displacement of the pressure roller 236*a* is determined so that the distance L223 between the succeeding document D2 positioned at the standby position 224*b* and the preceding document D1 positioned at the scanning position 24*a* is approximately equal to the distance L213 between the documents D1 and D2 provided in the case of the foregoing dimension L211, i.e. to the difference between the document sizes L211 and L221.

The distance L223 does not necessarily have to be exactly equal to the distance L213 for the dimension L211, but should only be determined so that the succeeding document D2 can be placed close to the preceding document D1 but not so close as to contact it.

Since the pressure roller 236*a* is displaced in position, the transport distance L222 on the transparent plate 24 that the succeeding document D2 travels to reach the standby position 224*b* is sufficiently greater than the transport distance L212 provided in the case of the foregoing dimension L211. As a result, the distance that the succeeding document D2 needs to travel from the standby position 224*b* to the scanning position 24*a* after completion of the scanning of the preceding document D1 is equal to the sum of the dimension L221 and the distance L223, which is substantially short as compared with the distance W21 needed in the case of the dimension L211. When transporting the succeeding document D2 to the scanning position 24*a*, the pressure roller 236*a* is moved to its home position so that the transporting force of the belt 35 is sufficiently transmitted to the document D2. After the document D2 has been transported to the scanning position 24*a*, the pressure roller 236*a* is moved again horizontally according to the size of the document D2.

Further, FIG. 15(3) shows the condition in which a document D1 having a dimension L231 along the document transporting direction has been transported to the document scanning position 24*a*, where the dimension L231 has the following relationship with respect to the distance W23 between the stop member 47 and the pressure roller 236*a*.

$$W23 > L231 \quad (13).$$

When it is determined that the size of the supplied document D1 satisfies the above relationship (13), the pressure roller 236*a* at the upstream end with respect to the transporting direction is moved close enough to the adjacent pressure roller 236*b*. As a result, the document D1 is transported to the scanning position 24*a* by being pressed by the pressure rollers 236*a*–236*d*, leaving a sufficient-length clearance between the belt 35 and the transparent plate 24 upstream of the pressure roller 236*a* and thus allowing the succeeding document D2 to be preliminarily fed to the standby position 224*b* where the leading edge thereof contacts the pressure roller 236*a*. The distance L233 between the preceding document D1 and the succeeding document D2 on standby is equal to the difference between the distance W23 and the dimension L231, which means that the distance L233 is determined by the dimension L231.

Also, as the pressure roller 236*a* is displaced in position, the transport distance L232 on the transparent plate 24 that the succeeding document D2 travels to reach the standby position 224*b* is sufficiently greater than the distance L222 provided in the case of the foregoing dimension L221. As a result, the distance that the succeeding document D2 needs to travel from the standby position 224*b* to the scanning position 24*a* after completion of the scanning of the preceding document D1 is substantially short as compared with the distance needed in the case of the foregoing dimension L211 or L221. When transporting the succeeding document D2 to the scanning position 24*a*, the pressure roller 236*a* is moved to its home position so that the transporting force of the belt 35 is sufficiently transmitted to the document D2. After the document D2 has been transported to the scanning position 24*a*, the pressure roller 236*a* is moved again horizontally according to the size of the document D2.

To recapitulate, the pressure roller 236*a* at the upstream end with respect to the document transporting direction is moved toward the downstream side in correspondence with the reduction in the size of the document D1 measured along the transporting direction 26 thereof. That is, as the document size is reduced, the pressure roller 236*a* is moved closer to the pressure roller 236*b*, and as the document size increases, it is moved away from the pressure roller 236*b*. As a result, the document D2 that follows the preceding document D1 can be preliminarily fed to the standby position as close as possible to the preceding document D1 positioned stationary for exposure. In the prior art construction, the transport distance to the standby position remains unchanged even when the document size is changed. According to the present embodiment, however, since the transport distance can be set according to the document size, it is possible to markedly reduce the distance that the succeeding document D2 needs to travel from the standby position to the scanning position after the preceding document D1. This results in a marked reduction in the total time needed to sequentially transport a plurality of documents to the scanning position.

The distances W21, W22, and W23 are so set as to accommodate various document sizes measured along the document transporting direction 26, such as A3 size, B5 size, etc., within the ranges provided by the respective expressions (11) to (13).

After completion of the exposure process, a solenoid SOL (not shown) or the like is actuated to retract the protruding stop member 47 as indicated by dotted lines in FIG. 17, thereby opening a transport path 49 leading from the scanning position 24*a* to the downstream side in the transporting direction. As the transport path 49 is opened, the belt 35 is restarted to rotate clockwise for transportation into the transport path 49 of the document D that has been scanned. At the same time, the succeeding document D2 that has been fed for standby at the standby position 224*b* is now transported along the transporting direction 26 toward the scanning position 24*a*. At this time, the pressure roller 236*a* that has been displaced in position according to the document size, as described above, is moved to its home position so that the transporting force of the belt 35 is sufficiently transmitted to the document D2. When the succeeding document D2 has been transported to the scanning position 24*a*, the pressure roller 236*a* is again moved horizontally according to the size of the thus transported document D2, as described above, so that a clearance is created to provide a standby position for a further succeeding document D3. The succeeding document D3 is then preliminarily transported to the standby position.

Figure 23:
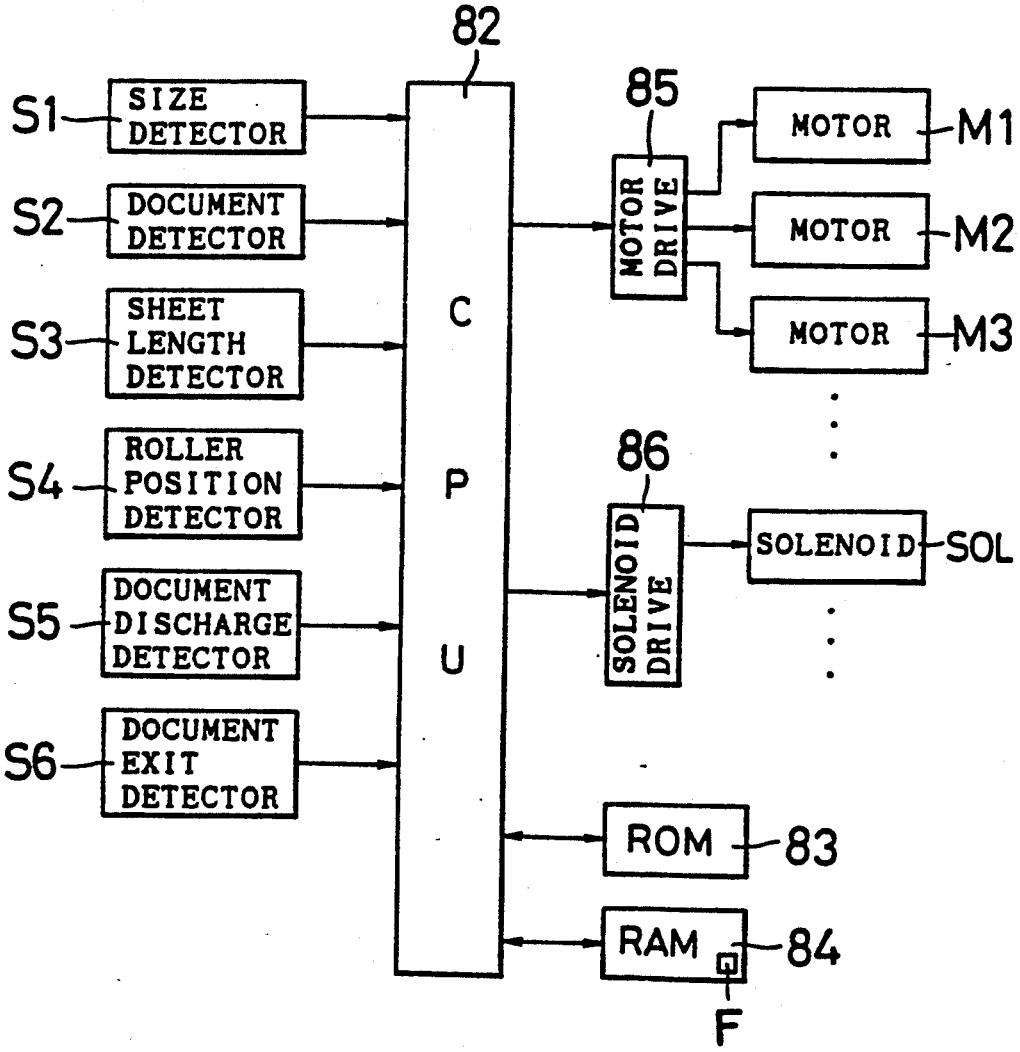
FIG. 23 is a block diagram illustrating the electrical configuration of the document feeding apparatus 21*c*.

FIG. 23 is a block diagram showing the electrical configuration of the document feeding apparatus 21*c*. Detection signals from the size detector S1 for detecting the size, measured along the document transporting direction, of the document D being transported, the sheet length detector S3, the document detector S2 for detecting the transporting condition of the document, the document discharge detector S5, the document exit detector S6, and the roller position detector S4 for detecting the positioning of the pressure roller 236*a* are supplied to a central processing unit 82 (hereinafter abbreviated as CPU) which consists, for example, of a microcomputer. The CPU 82 judges the transporting condition of the document based on the detection signals and controls the relevant circuits accordingly.

A read-only memory (ROM) 83 and a random-access memory (RAM) 84 are connected to the CPU 82. In accordance with control programs contained in the ROM 83, the CPU 82 controls copying operations by cooperating the copying machine 22 with the document feeding apparatus 21*c*. The RAM 84 is used, for example, as operating areas of counters, timers, flags, etc. which become necessary for the control of copying operations. An example of the flag area is the area of a matching flag F used to decide the matching described hereinafter between the size, measured along the transporting direction, of the document D being transported and the positional displacement of the pressure roller 236*a*.

A motor driving circuit 84, a solenoid driving circuit 85, etc. are also connected to the CPU 82. These driving circuits 85, 86 are controlled in accordance with programs contained in the memories 83 and 84 based on the signals from the detectors S1–S6. Connected to the motor driving circuit 85 are various motors such as a motor M1 for moving the pressure roller 236*a* in horizontal directions, a motor M2 for rotating the rollers 33 and 34 to drive the belt 35, and a motor M3 for driving the various transport rollers. Various solenoids, including the solenoid SOL for causing the stop member 47 to protrude and retract from the surface of the transparent plate 24, are connected to the solenoid driving circuit 86.

Figure 24:
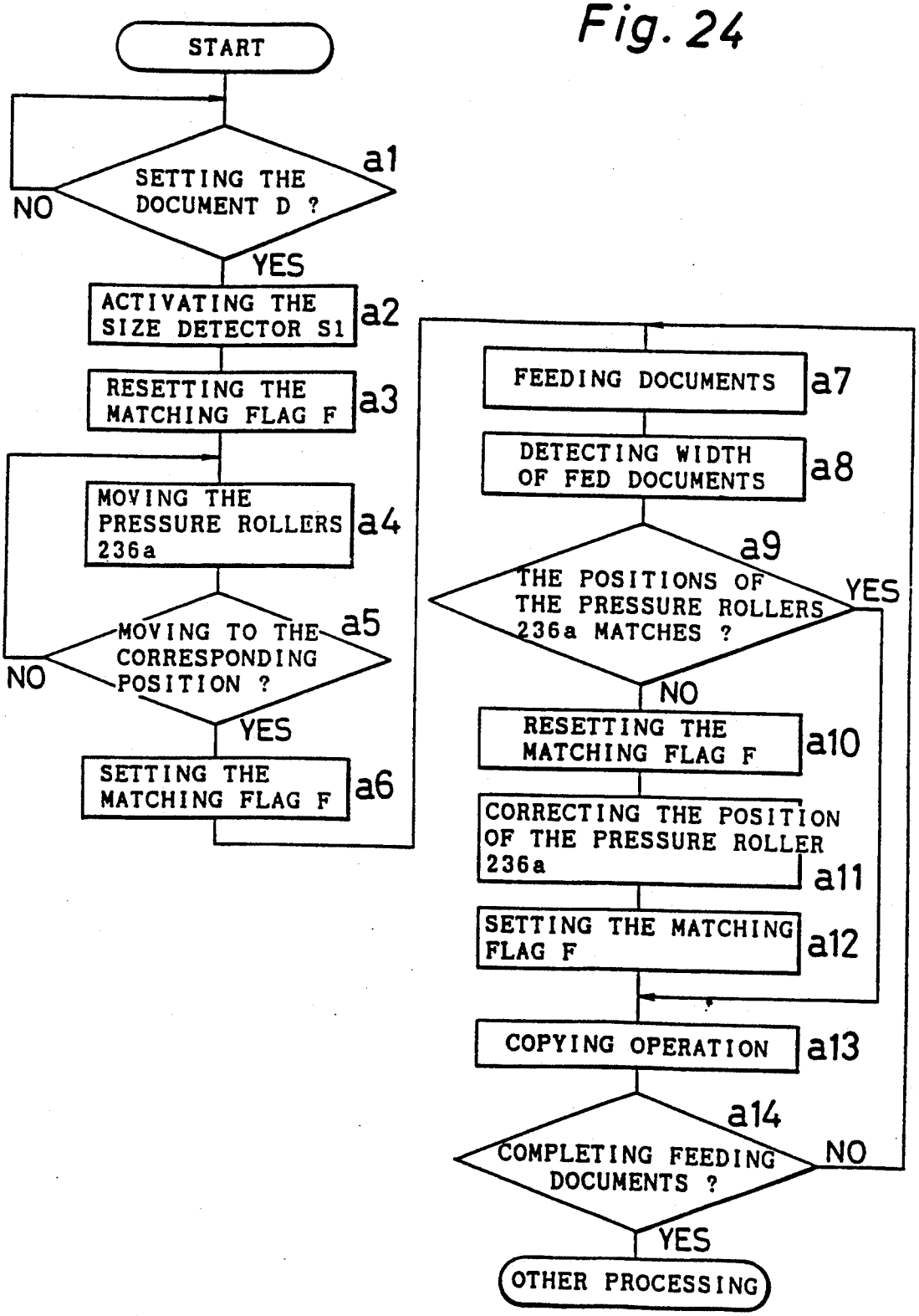
FIG. 24 is a flowchart explaining the document feeding operation in the third embodiment.

FIG. 24 is a flowchart explaining the document feeding operation in this embodiment. The program shown in FIG. 24 is initiated upon depression of the print switch when documents D to be copied are placed on the document loading tray 25. The documents D stacked on the document tray 25 may include sheets of different sizes such as A4 and A3.

At step a1, based on the detection result of the document detector S2, it is determined if documents D to be copied are placed on the document loading tray 25. When the presence of the documents D is detected, the size detector S1 is activated at step a2, to identify the size of the documents D by combining, for example, the detection result of the size detector S1 with the positioning limits provided by the alignment plates 27. However, the document size identified at this step is based on the size detected by the size detector S1, and all different sizes of sheets stacked together are not identified. For example, when documents of A4 size are stacked on documents of A3 size, the document size identified at this step is A3 size.

At step a3, the matching flag F is reset to enable the pressure roller 236*a* for positional control. At step a4, in accordance with the size of the document D identified at step a2, the pressure roller 236*a* is moved horizontally to control the position at which to apply pressure on the belt 35. At step a5, based on the detection result of the roller position detector S4, it is determined if the pressure roller 236*a* has moved to the corresponding position. Steps a4 and a5 are repeated until the positioning is confirmed. After the positioning, at step a6, the matching flag F is set to indicate that the positional control of the pressure roller 236*a* is complete.

Thereafter, at step a7, the document D is fed from the top of the stack on the document loading tray 25. At step a8, the size of the document D being fed is detected by the sheet length detector S3. Even if the document size is different from the one previously detected by the size detector S1, this process allows the size of the document to be properly identified during transportation to the scanning position 24*a*, thus permitting proper positional control of the pressure roller 236*a* as described hereinafter.

At step a9, based on the detection result of the roller position detector S4, it is determined if the previously set position of the pressure roller 236*a* matches the detection result of the sheet length detector S3. If the document size and the roller position match, the process proceeds to step a13 in which the document D transported to the scanning position 24*a* is scanned by the optical scanning means 48. On the other hand, at step a9, if it is determined that the roller position does not match the detected document size, the process proceeds to step a10 in which the matching flag F is reset once again and the pressure roller 236*a* is moved for corrective positioning so as to match the size of the document D. Thereafter, at step a12, the matching flag F is set, and at step a13, a scanning operation is performed on the document D transported to the scanning position 24*a*.

The processing at steps a8–a12 is performed to correct the roller position in order to achieve higher quality and higher speed in copying operation and may be omitted. When steps a8–a12 are omitted, the pressure roller 236*a* is controlled based only on the size detected by the size detector S1.

When the scanning operation is completed, the process proceeds to step a14 in which it is decided if all the documents have been fed, based on the detection result of the document detector S2. If the decision is negative, the process returns to step a7 and the above described process is repeated, the position of the pressure roller 236*a* being corrected according to the size of each of the documents D sequentially fed. On the other hand, if the decision at step a14 is affirmative, other processing is performed, for example, to stop the operation of the copying machine 22 and document feeding apparatus 21*c*.

Thus, according to the present embodiment, when sequentially feeding a plurality of document sheets to the scanning position, the position of the pressure roller at the upstream end with respect to the document transporting direction is moved by a simple mechanism in such a manner as to change its position at which to apply pressure to the belt according to the size of the preceding document. This allows the succeeding document to be preliminarily fed to a standby position as close as possible to the preceding document. As a result, the distance the succeeding document that follows the preceding document needs to travel to reach the scanning position, and hence the length of time needed to transport the document to that position, is markedly reduced, which eventually leads to a marked reduction in the total time needed to sequentially transport a plurality of documents to the scanning position. Accordingly, the copying time in the copying machine can be reduced markedly.

The above embodiment has been described in connection with the construction of an electrostatic image transfer copying machine, but it will be appreciated that this embodiment can also be applied to a construction in which copying is made, for example, on photosensitized recording paper.

Figure 25:
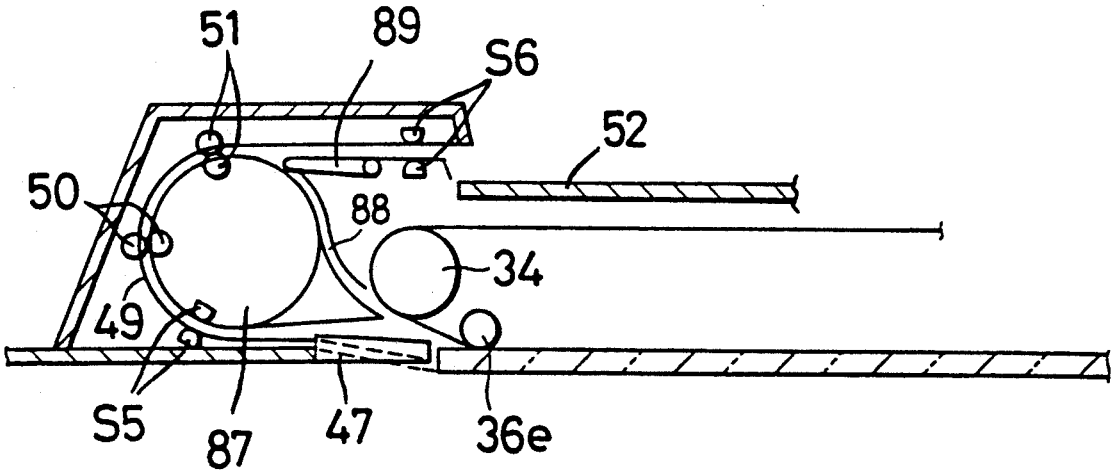
FIG. 25 is a cross sectional view showing the another structure of the document feeding apparatus 21*a*, 21*b*, 21*c*.

Any of the document feeding apparatus 21*a*, 21*b*, and 21*c* described in connection with the embodiments 1–3 is not provided with a document inverting device for turning over the document, but it will be appreciated that the present invention may be embodied in a document feeding apparatus having a document inverting device as shown in FIG. 25.

In the document feeding apparatus shown, a transport path 49 is formed along the outer circumferential surface of an inverting roller 87, the transport path 49 branching in the vicinity of a transport roller 51 to form a transport path extending along the outer circumferential surface of the inverting roller 87 toward the roller 34 and pressure roller 36*e*. A diverting pawl 89 is provided where the transport path 49 branches. When discharging the document, the transport path 88 is closed with the diverting pawl 89 to direct the document to the document exit tray 52. When inverting the document, the diverting pawl 89 is moved to open the transport path 88 to refeed the document onto the transparent plate 24 that provides the document feed position 24*a*.

EMBODIMENT 4

Figure 26:
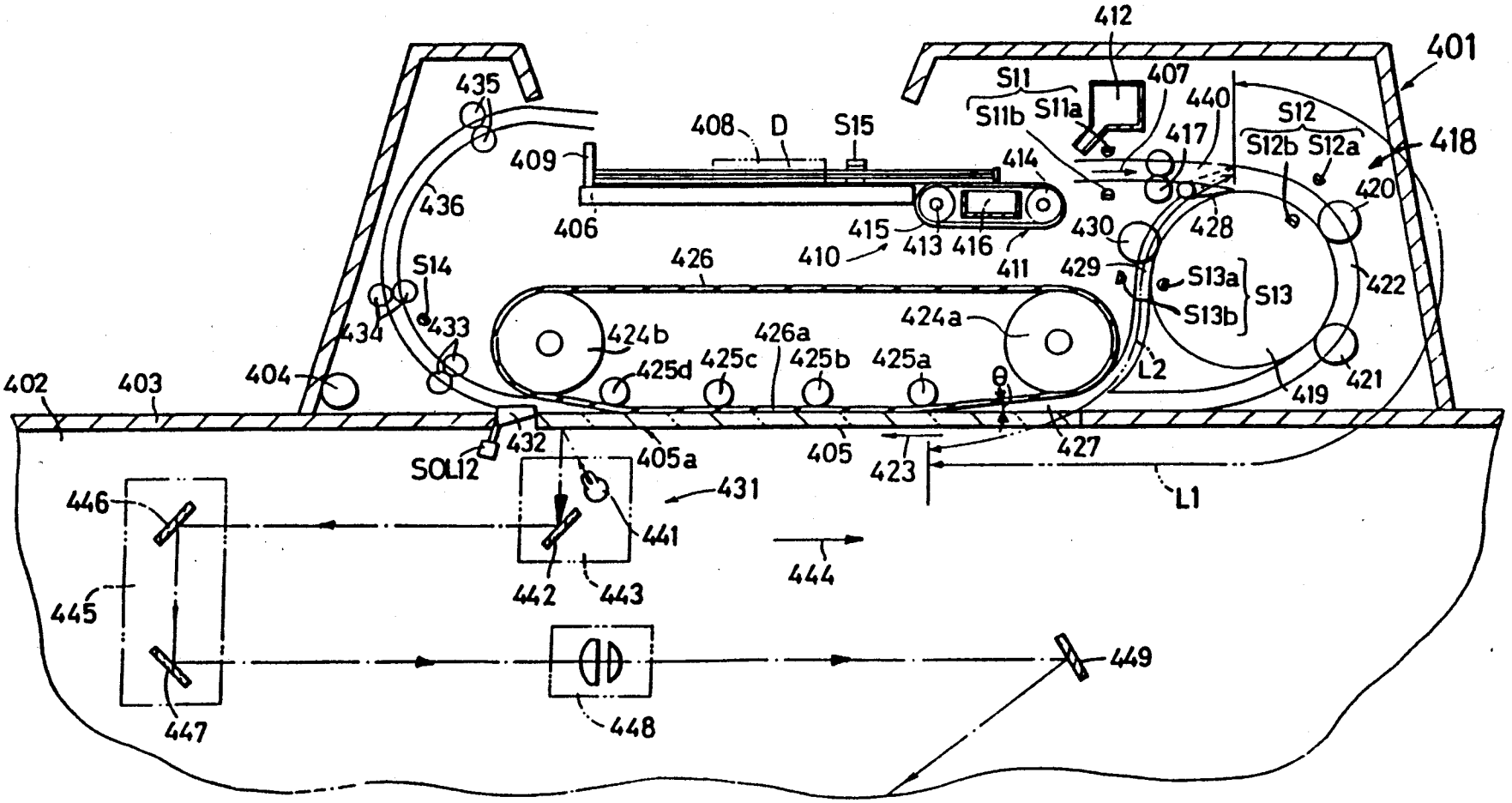
FIG. 26 is a cross sectional view schematically showing the structure of a document feeding apparatus 401 in a fourth embodiment of the invention.
Figure 27:
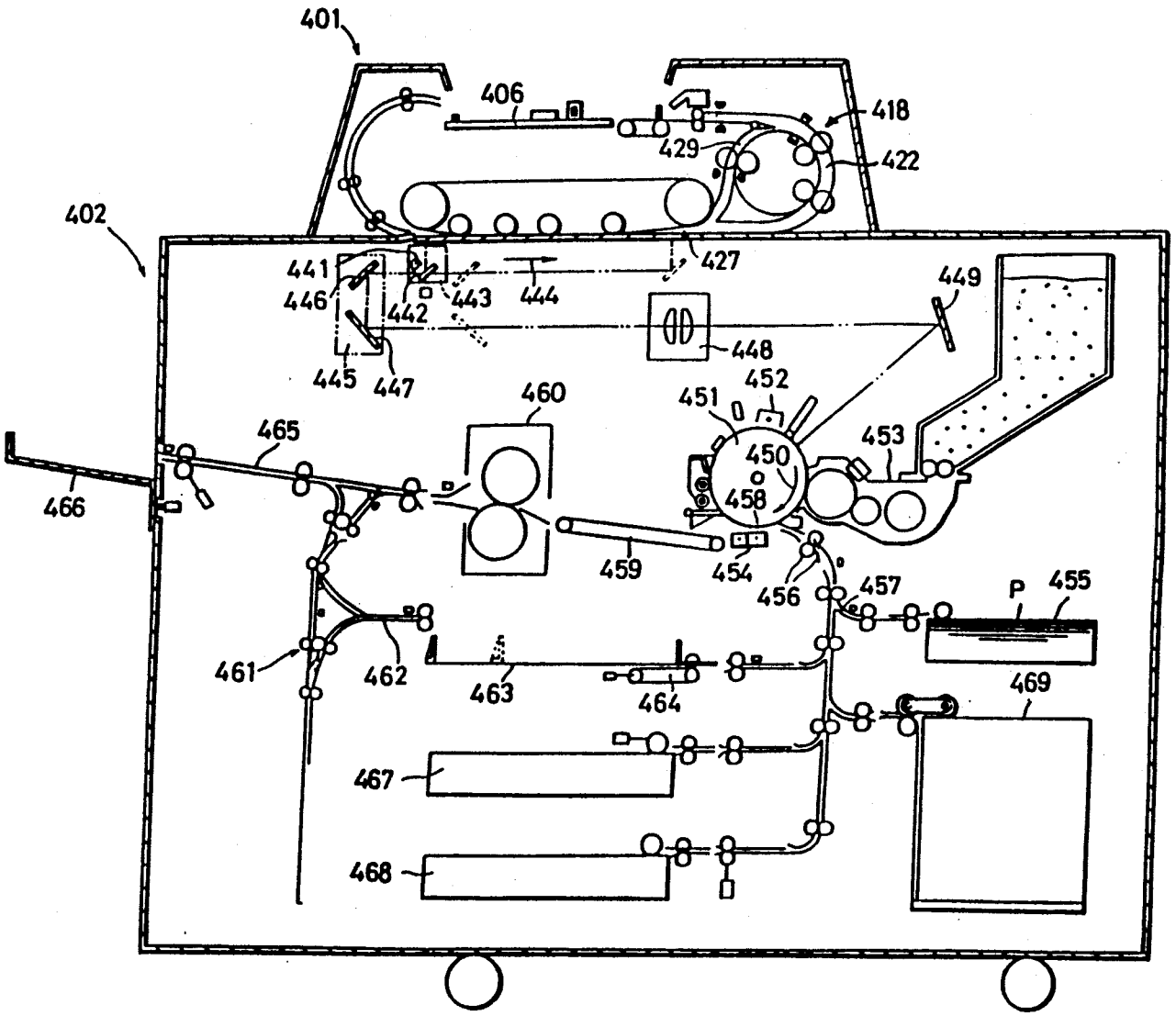
FIG. 27 is a cross sectional view schematically showing the structure of an electrostatic copying machine 402 equipped with the document feeding apparatus 401.

FIG. 26 is a cross sectional view schematically showing the structure of a document feeding apparatus 401 in a fourth embodiment of the invention, and FIG. 27 is a cross sectional view schematically showing the structure of an electrostatic image transfer copying machine 402 equipped with the document feeding apparatus 401.

A transparent plate 405 formed from hard glass or other material is installed on the top surface 403 of the copying machine 402. The transparent plate 405 provides a document scanning area. The document feeding apparatus 401 is mounted above the transparent plate 405 and is fitted to one side of the top surface 403, for example, in such a manner as to be rotatable about an axis of rotation 404. When the document feeding apparatus 401 is not used for feeding of documents (for example, when the document is a book or the like), the apparatus 401 is turned around about the axis of rotation 404 and the document is placed on the transparent plate 405 with the document image to be copied facing the interior side of the copying machine so that the copying operation is performed while the document is held pressed down thereon.

Generally, as shown in FIGS. 26 and 27, the document feeding apparatus 401 is mounted in such a manner as to cover the transparent plate 405 so that sheets of document D stacked on a document feed tray 406 are automatically fed in sequential fashion to a document scanning position 405*a* on the transparent plate 405 to present the document image for copying. The thus presented document image is optically scanned by an optical scanning means provided in the copying machine 402 for exposure of the document image. The document D whose image has been scanned is returned to the document loading tray 406 for storing therein. The above transport operation is sequentially performed on the documents D stacked on the document loading tray 406 so that the documents D are circulated according to the required number of copies, thereby accomplishing simplex (single-sided) or duplex (two-sided) copying on recording paper P.

With reference to FIG. 26, the structure of the document feeding apparatus 401 is described below.

The documents D to be copied are stacked on the document loading tray 406. The document loading tray 406 is provided with a pair of alignment plates 407 disposed opposite each other across the width of the stacked documents D which are fed in direction 407 parallel to the alignment plates 408. The alignment plates 408 are moved in opposite directions closer to or away from each other according to the widthwise size of the stacked documents D in order to align the widthwise sides of the documents D. As a result, the widthwise center of the stacked documents D is always at the same position regardless of the widthwise size thereof. Also, at the upstream end of the document loading tray 406 with respect to the transporting direction 407 of the stacked documents D, there is disposed a trailing edge alignment plate 409 for aligning the trailing edges of the stacked documents D.

Downstream of the document loading tray 406 in the transporting direction is disposed a document feeding means 410 for feeding the documents D one by one in sequential fashion. The document feeding means 410 comprises, for example, a suction transport means 411 disposed below the document loading tray 406 and an exhaust duct 412 disposed above the document loading tray 406. The suction transport means 411 comprises two drive rollers 413 and 414 each having an axis extending in a direction perpendicular to the transporting direction 407 and an endless belt 415 having numerous openings therein and passed around the two drive rollers 413 and 414. A suction duct 416 is disposed inside the endless 415. When a suction fan not shown is driven, suction force is generated through the suction duct 416 and the suction force is applied through the belt 415 to suck the bottommost sheet of the stacked documents D onto the belt 415. Therefore, by rotating the belt 415 in the clockwise direction (see FIG. 26), the documents D are sequentially fed from the bottom of the stack in the transporting direction 407.

A stream of air is blown from the nozzle of the exhaust duct 412 toward the leading edges of the documents D in the lower part of the stack. This serves to separate the leading edges of the documents and thus ensures that the documents D are fed one by one by the suction transport means 411. Thus, the stacked documents D are fed sequentially from the bottom of the stack by the document feeding means 410. It should be appreciated that the construction of the document feeding means 410 is not limited to the one described above.

The document D fed by the document feeding means 410 is transported along a transport path 440 by transport rollers 417 and directed into an inverting means 418. Downstream of the document loading tray 406 in the document transporting direction is disposed a first transport detector S11 consisting, for example, of a light emitting element S11*a* and a light receiving element S11*b*. The first transport detector S11 detects one-by-one feeding of the documents D.

In FIG. 26, the inverting means 418 is formed around the outer surface of a support drum 419 which is substantially cylindrical in shape. The transport path 440 that includes the transport rollers 417 branches into two paths when it reaches the outer surface of the support drum 419, one being a first transport path 422 curving clockwise (in FIG. 26) and the other being a second transport path 429 curving counterclockwise. In the first transport path 422, there are disposed transport rollers 420 and 421 which are rotatable in both forward and backward directions and which apply pressure to transport the document D along the outer surface of the support drum 419. The first transport path 422 is also provided with a second transport detector S12 consisting, for example, of a light emitting element S12*a* and a light receiving element S12*b*. The second transport detector S12 detects the transporting condition of the document D passing through the first transport path 422, based on which the rotating timing, direction, etc. of the transport rollers 420 and 421 are controlled.

In the second transport path 429, there is disposed a transport roller 430 which applies pressure to transport the document D along the outer surface of the support drum 419. The transport roller 430 rotates only in one direction. The second transport path 429 is also provided with a third transport detector S13 consisting, for example, of a light emitting element S13*a* and a light receiving element S13*b*. The third transport detector S13 detects the transporting condition of the document D passing through the second transport path 429, based on which the rotating timing and other parameters of the transport roller 430 are controlled.

A diverting pawl 428 which is driven by a solenoid SOL11 not shown is disposed at the position where the transport path 440 branches into the first and second transport paths 422 and 429. When the solenoid SOL11 is deenergized, for example, the passage is opened as shown by the solid line in FIG. 26 so that the document D is transported from the transport path 440 into the first transport path 422. On the other hand, when the solenoid SOL11 is energized, the diverting pawl 428 is moved to a position shown by the dotted line, opening the passage for directing the document D from the first transport path 422 into the second transport path 429. The solenoid SOL11 is energized or deenergized depending on the detection result of the second transport detector S12.

The ends of the first and second transport paths 422 and 429 opposite from the ends at which the diverting pawl 428 is provided are united in the vicinity of the upstream end of the transparent plate 405 with respect to the transporting direction 423. Therefore, the document D transported through the inverting means 418 in accordance with each individual copy mode set as hereinafter described is fed along the transporting direction 423 onto the transparent plate 405.

Above the transparent plate 405, there are disposed a pair of rollers 424*a* and 424*b* each having an axis extending parallel to the widthwise direction of the document D being transported, and a plurality of endless belts 426 are passed around the pair of rollers 424*a* and 424*b*. On the inside of the belts 426 and adjacent to the lower taut portions 426*a* thereof are disposed a plurality of pressure rollers 425*a*–425*b* (four in this embodiment) spaced apart in this order along the transporting direction 423. The pressure rollers 425*a*–425*d* apply pressure to press the belts 426 against the transparent plate 405, thereby keeping the belts 426 from stacking while preventing the document D fed between the belts 426 and the transparent plate 405 from lifting.

In this embodiment, a clearance is formed on the upstream side of the transparent plate 405 with respect to the document transporting direction 423 as a result of the difference in elevation between the support position of the belts 426 on the roller 424*a* and that of the belts 426 on the pressure roller 425*a*. That is, upstream of the pressure roller 425*a*, the belts 426 are stretched forming a prescribed angle $\theta$ to the transparent plate 405 as measured at the pressure roller 425*a*.

In this embodiment, the clearance provides a third transport path 427 communicating with the first and second transport paths 422 and 429 of the inverting means 418. Therefore, the document D can be fed into the third transport path 427 by the transporting force of the transport rollers 420, 421, and 430 of the inverting means 418 even when the rotation of the belts 426 is stopped.

The document D transported along the transparent plate 405 by means of the belts 426 is conveyed up to the scanning position 405*a* on the transparent plate 405. The scanning position 405*a* refers to the position at which the leading edge of the thus transported document D contacts a protruding stop member 432 disposed near the downstream end of the transparent plate 405 in the transporting direction 423. The document thus transported to the scanning position 405*a* is positioned with its document image to be copied facing the interior side of the copying machine so that the document image is optically scanned by an optical system 431, the optical scanning means provided inside the copying machine 402, thus accomplishing the exposure of the document image.

While the preceding document is being scanned for exposure, preliminary feeding of the succeeding document is performed. The preliminary feeding is completed when the succeeding document is fed into the third transport path 427 to stand by for the next operation. The distance between the stop member 432 and the pressure roller 425*a* which the leading edge of the preliminarily fed document reaches is appropriately determined so that the distance is sufficiently great to accommodate the transported document regardless of the document size and so that the succeeding document is prevented from contacting the preceding document.

When the scanning of the document image is completed, the stop member 432 is retracted by means of s solenoid SOL12 to open the passage leading from the scanning position 405*a* to a transport path 436. At the same time, the belts 426 are restarted to rotate, and the document D is transported along the transport path 436 by means of transport rollers 433–435 and returned to the top of the stack of documents D on the document loading tray 406.

The transport path 436 is provided with a document discharge detector S14 and other sensors for detecting the transporting condition of the document D, based on which the energization timing and other parameters of the solenoid SOL12 are controlled. Also, a circulation detector S15 for detecting one circulation cycle of the stacked documents D is disposed in the vicinity of the document loading tray 406. The circulation detector S15 comprises, for example, an actuator contacting the top of the stacked documents D and determines that all the documents D have been fed to complete one circulation cycle when the absence of the documents D between the actuator and the document loading tray 406 is detected after the documents D have been fed.

As described, the document image presented at the scanning position 405 is scanned by the optical system 431 for exposure. In the optical system 431, a first moving unit 443 containing a light source 441 such as a halogen lamp and a reflecting mirror 442 reciprocates in horizontal direction 444 along the scanning position 405*a* to illuminate the presented document. The light from the document is reflected into reflecting mirrors 446 and 447 in a second moving unit 445 and then into a zoom lens 448 which then transmit it to a reflecting mirror 449 and on to a photoreceptor 451 of a right circular cylindrical shape which is rotating in the direction indicated by arrow 450. The second moving unit 445 is also moved in the same direction but at half the traveling speed of the first moving unit 443 so that the light path length of the reflected light is maintained constant.

An electrostatic latent image corresponding to the thus projected document image is formed on the outer circumferential surface of the photoreceptor 451 which has previously been charged by a charge corona discharger 452. The electrostatic latent image is then developed into a toner image by means of a developing unit 453 and is transferred onto one side of recording paper P by means of a transfer corona discharger 454. Prior to this process, the recording paper P fed from a paper cassette 455 has been transported along a transport path 457 having a pair of resist rollers 456 to a transfer station 458 where the transfer is performed.

A power transmitting means is connected to the axle of the resist roller 456 via a clutch CLT not shown. By controlling the engagement and disengagement of the clutch CLT in conjunction with the control of the transport timing of the document D in the document feeding apparatus 401, it is possible to match up the timing for the resist rollers 456 to transport the recording paper P with respect to the toner image on the photoreceptor 451. The recording paper P onto which the toner image has been transferred by the transfer corona discharger 454 is transported via a transport means 459 to a fixing unit 460 where the toner image is fused to the recording paper P.

After the fixing, the recording paper is passed through a recording paper inverting means 461 by which the transporting direction of the recording paper P is inverted, after which the recording paper P is transported through a transport path 462 and fed into an intermediate tray 463 for temporary storage. The recording paper P stored in the intermediate tray 463 is fed back to the transfer station 458 by means of a transport means 464 and the resist rollers 456 so that a toner image is transferred to the other side of the recording paper P. After the transfer, the recording paper P is transported via the transport means 459, the fixing unit 460, and the transport path 465 and is discharged onto an exit tray 466 outside the copying machine. Thus, the corresponding document images are copied on the respective sides of the corresponding recording paper P. On the other hand, when making a simplex (single-sided) copy, the recording paper P with the image copied on one side thereof is discharged onto the exit tray 466 instead of being directed to the intermediate tray 463. The paper cassettes 455, 467, 468, and 469 respectively hold recording paper P of different sizes, for example, and the proper size paper is selected for transportation to the transfer station 458.

Figure 28:
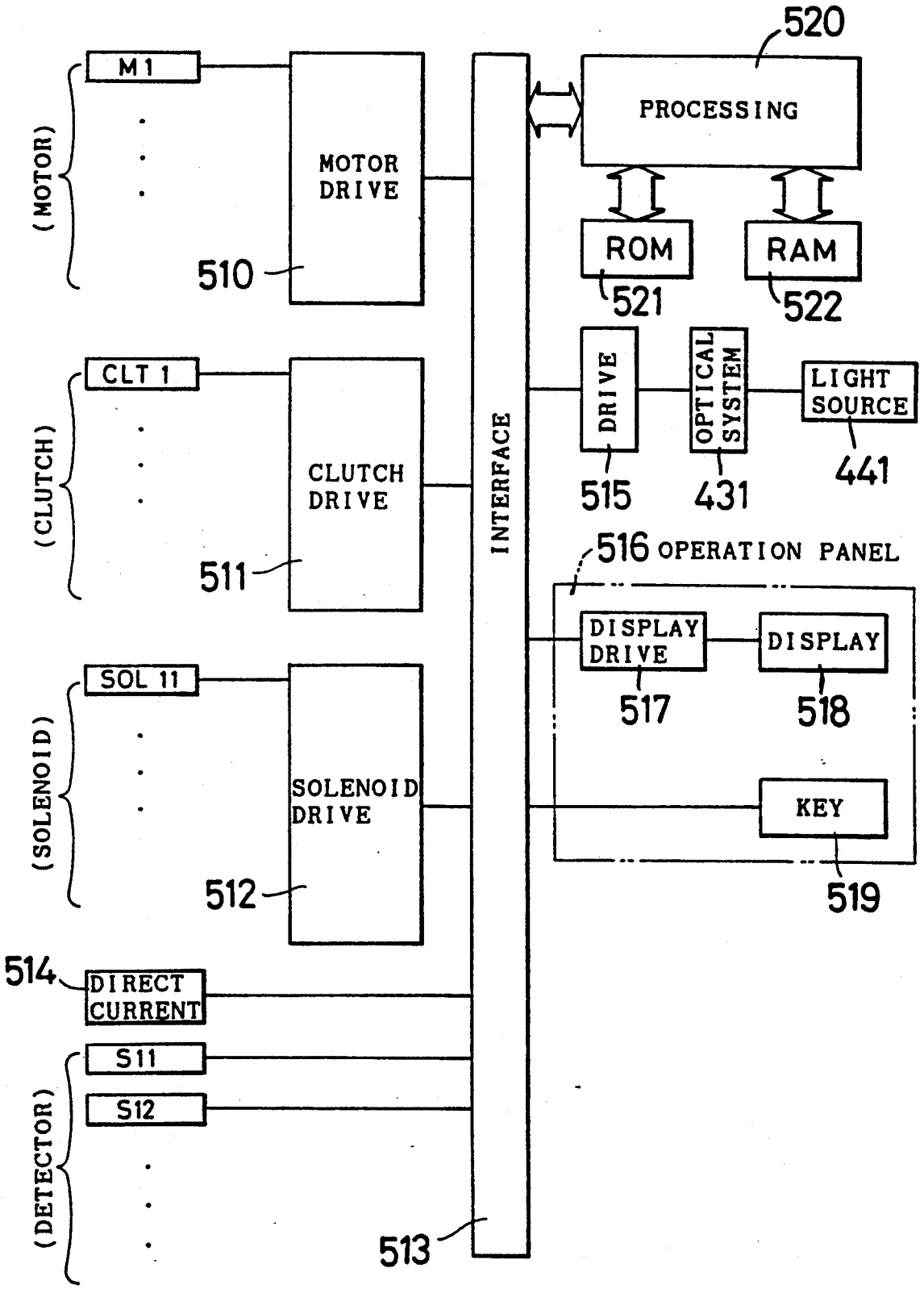
FIG. 28 is a block diagram illustrating the electrical configuration of the document feeding apparatus 401 and copying machine 402.

FIG. 28 is a block diagram illustrating the electrical configuration of the document feeding apparatus 401 and copying machine 402. Various motors including the motor M1 for driving the plurality of rollers, etc. are connected to a motor driving circuit 510, various clutches including the clutch CLT for controlling the resist rollers, etc. are connected to a clutch driving circuit 511, and various solenoids including the solenoid SOL11 for controlling the diverting pawl 428, etc. are connected to a solenoid driving circuit 512. These driving circuits 510–512 and control elements, such as a DC power supply 514, for controlling the document transportation, recording paper transportation, and copy process are connected to an interface circuit (I/O) 513. The various detectors S11, S12, etc. for detecting the document D and recording paper P being transported are also connected to the interface circuit 513 to which a microcomputer (CPU) 520 is connected. Signals from the detectors are supplied to the microcomputer 520 which performs necessary operations on these signals and supplies drive control signals to the respective driving circuits 510–512 via the interface circuit 513.

A read-only memory (ROM) 521 and a random-access memory (RAM) 522 are connected to the microcomputer 520. Using a memory area in the RAM 522 as a work area, the microcomputer 520 performs control operations in accordance with control programs stored in the ROM 521.

The optical system 431 is connected to the interface circuit 513, via a driving circuit 515, which drives the light source 441 and supplies display control signals to various display parts on an operation panel 516 via a display driving circuit 517. Operation keys 519 are also connected to the interface circuit 513.

The following describes how the document feeding apparatus 401 operates to transport the document D in various copy modes.

FIG. 29(1) shows how a simplex (single-sided) document D is transported. For convenience sake, the positional relations between the document loading tray 406, the transparent plate 405, and the inverting means 418 are shown in a simplified form in FIG. 29(1). The simplex (single-sided) documents D to be copied are stacked on the document loading tray 406 with their image side facing upward. As the diverting pawl 428 is locked into position as shown by the solid line in FIG. 26, the document D fed from the bottom of the stack is transported into the first transport path 422 in the inverting means 418. The document D passed through the first transport path 422 is guided through the third transport path 427 formed on the upstream side of the transparent plate 405 with respect to the transporting direction, and is transported to the scanning position 405*a*. By passing through the inverting means 418, the document D placed face up on the document loading tray 406 is inverted or turned over to present its document image on the scanning position 405*a*.

After the presented document image has been scanned by the optical system 431, the belts 426 are restarted so that the document D is transported along the transport path 436 and returned to the top of the stack of documents D on the document loading tray 406. The image of the simplex (single-sided) document fed to the scanning position 405*a* is thus scanned, producing a simplex (single-sided) or duplex (two-sided) copy on recording paper P with the document feeding apparatus 401 cooperating with the copying machine 402.

In order to sequentially feed a plurality of documents to the scanning position 405*a*, it is necessary to preliminarily feed a document, that succeeds the preceding document, to a standby position as close as possible to the preceding document currently being scanned. According to the present embodiment, since the third transport path 427 is formed on the transparent plate 405 continuously with the first transport path 422, the succeeding document can be preliminarily fed until the leading edge thereof reaches a point near the pressure roller 425*a* on the third transport path 3, thus positioning the succeeding document on standby sufficiently close to the preceding document. The first transport path 422 and the third transport path 427 combine to provide a sufficient path length L1 (see FIG. 26) for the inverting and preliminary feeding of the document in simplex (single-sided) copying operation.

Therefore, by appropriately setting the third transport path 427, it is possible to substantially reduce the size of the inverting means 418 which has previously been restricted by the length of the first transport path 422. Also, because of the reduced size of the inverting means 418 and the implementation of the preliminary feeding, the provision of the aforementioned path length does not lead to an increased time for transportation of the document D or other restrictions.

FIG. 29(2) shows how a duplex (two-sided) document is transported. The duplex (two-sided) documents D having document images on both sides for copying are stacked on the document loading tray 406 with their page numbers collated, for example, from top to bottom of the stack. The document D fed from the bottom of the stack is transported to the inverting means 418. The diverting pawl 428 is first set as shown by the solid line in FIG. 26, so that the document D is transported along the first transport path 422 and on to the third transport path 427.

When the trailing edge of the document D being transported along the first transport path 422 in the transporting direction 407 has passed the diverting pawl 428 to activate, for example, the second transport detector S2, the transport rollers 420 and 421 on the first transport path 422 are driven for rotation in the reverse direction while the diverting pawl 428 is moved to the position indicated by the dotted line in FIG. 26. As a result, the document D is fed in the opposite direction and transported from the first transport path 422 to the second transport path 429 and on to the third transport path 427 via which the document D is guided to the scanning position 405*a* on the transparent plate 405.

Thus, the document D fed from the document loading tray 406 is positioned so as to present its one side on the scanning position 405*a* for scanning. After the one side has been scanned, the document D is inverted through the transport path 436 and returned to the top of the stack of documents D on the document loading tray 406. The above process is repeated until the one side of all the documents stacked on the document loading tray 406 have been presented for copying. In the meantime, recording paper sheets P each with the one side of the corresponding document copied on one side thereof are sequentially stacked on the intermediate tray 436 inside the copying machine 402.

Next, the transport operation as shown in FIG. 29(2) is repeated on the documents D that have been returned and stacked on the document loading tray 406, so that the other sides of the documents D that have not yet been copied are presented for exposure at the scanning position 405. The other side of each document is scanned for copying onto the fresh opposite side of the corresponding recording paper P sequentially fed from the bottom of the stack on the intermediate tray 463, thus sequentially generating the recording paper P having corresponding images copied on both sides thereof. Each document D the top side of which has been scanned is again inverted through the transport path 436 and is returned to the top of the stack of documents on the document loading tray 406. Thus, the documents D circulated twice through the document feeding apparatus 401 are stacked in the same collated order as when they were stacked initially.

In transporting the duplex (two-sided) documents D also, it is necessary to perform preliminary feeding to reduce the copying time by feeding the succeeding document to a standby position sufficiently close to the preceding document being scanned.

According to the present embodiment, since the third transport passage 427 continuing from both the first transport path 422 and the second transport path 429 is provided on the transparent plate 405, the path length L1 for reversing the transporting direction of the document D that passed the diverting pawl 428 can be sufficiently secured, and also, the document D passed through the second transport path 429 can be fed in the transporting direction 423 until the leading edge thereof reaches a point near the pressure roller 425*a*, thus accomplishing preliminary feeding to bring the document D sufficiently close to the preceding document. That is, the path length L2 (see FIG. 26), the combined length of the second transport path 429 and third transport path 427, for preliminary feeding of a duplex (two-sided) document, as well as the above-mentioned path length L1, can be sufficiently secured by suitably setting the path length L3 of the third transport path 427.

This allows for reduction in the size of the inverting means 418. Also, because of the reduction in size of the inverting means 418 and the implementation of the preliminary feeding, the time needed to transport the document to the scanning position 405*a* is markedly reduced, which, as a result, achieves a marked reduction in the copying time.

Figure 30:
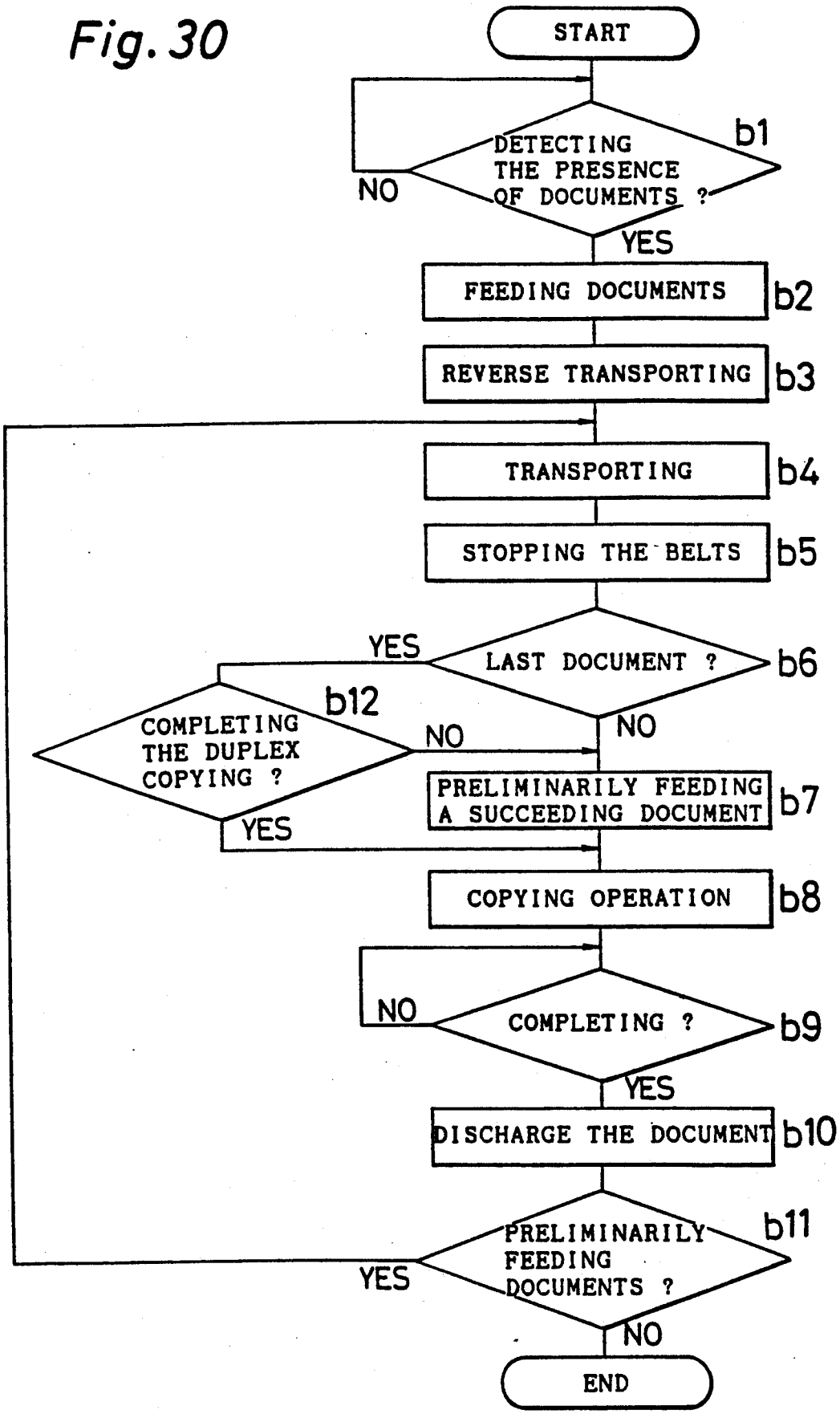
FIG. 30 is a flowchart explaining the document feeding operation in the fourth embodiment.
Figure 31:
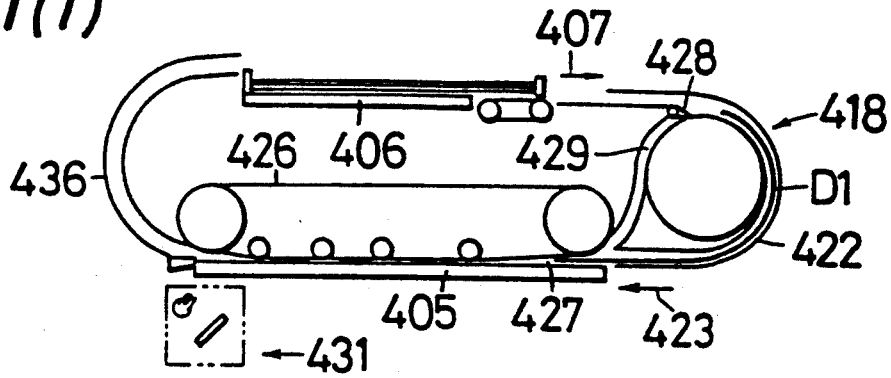
FIGS. 31(1)–31(5) are diagrams explaining stepwise the transportation of a duplex (two-sided) document.
Figure 31:
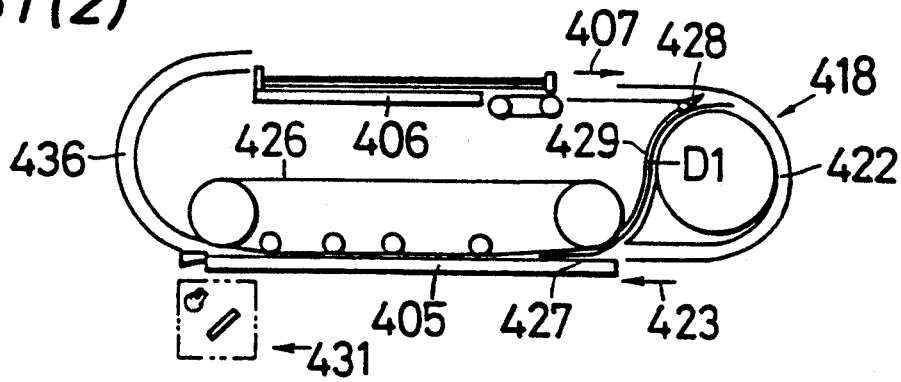
Figure 31:
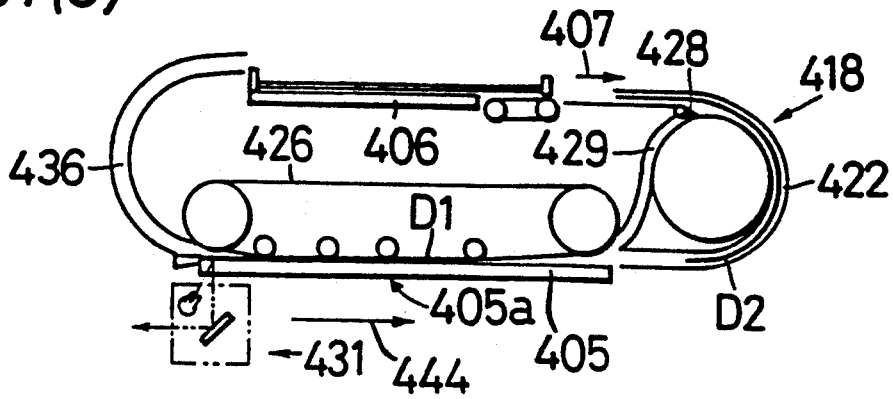

FIG. 30 is a flowchart explaining the document feeding operation in this embodiment, and FIG. 31 is a diagram explaining stepwise the transportation of a duplex (two-sided) document. With reference to FIGS. 30 and 31, the following describes how a duplex (two-sided) document D is transported according to this embodiment. FIG. 31 illustrates a case in which four documents D are used, and the numbers 1–4 suffixed to the reference sign D correspond to the order in which the documents are fed.

When the presence of documents D stacked on the document loading tray 406 is detected at step b1, the document D1 is fed from the bottom of the stack at step b2. At step b3, the document D1 whose trailing edge has passed the diverting pawl 428, as shown in FIG. 31(1), is reversely transported in the inverting means 418. As a result, the document D1 passes the activated diverting pawl 428 and is introduced along the second transport path 429 into the third transport path 427, as shown in FIG. 31(2).

As shown, according to the present embodiment, the third transport path 427 is formed between the belts 426 and the transparent plate 405 on the upstream side with respect to the document transporting direction in such a manner as to accommodate therein the document D passing through the first transport path 422 or the second transport path 429. Therefore, the first transport path 422 and the second transport path 429 can be reduced in length while at the same time sufficiently securing the aforementioned path lengths L1 and L2. This allows a reduction in the size of the inverting means 418.

At step b4, the document D introduced into the third transport path 427, as described above, is further transported by means of the belts 426. At step b5, the document D reaches the scanning position 405*a*, when the rotation of the belts 426 stops. At step b6, it is decided if the document D1 is the last document, based for example on the detection result of the circulation detector S15. If the decision is negative, the process proceeds to step b7 in which the preliminary feeding of a succeeding document, document D2 in this case, is initiated.

Thereafter, the process proceeds to step b8 in which, as shown in FIG. 31(3), the scanning by the optical system 431 is performed on the preceding document D1 while at the same time the preliminary feeding of the succeeding document D2 is performed. While the preceding document D1 is being scanned, the thus fed succeeding document D2 is transported, in the same manner as first described, along the first transport path 422 and the second transport path 429 and introduced into the third transport path 427, as shown in FIG. 31(4), where the document D2 is placed on standby at a position close enough to the preceding document D1. To recapitulate, the succeeding document D2 has been transported to a position close to the preceding document D1 before the completion of the scanning of the document D1.

Thereafter, at step b9, it is determined if the scanning operation has been completed. After the completion of the scanning, the process proceeds to step b10 in which the rotation of the belts 426 is restarted so that the document D1 on the scanning position 405*a* is discharged into the transport path 436. At step b11, it is decided if the document D2 to be copied subsequently to the document D1 being discharged has already been fed to the standby position.

If the decision is affirmative, the process returns to step b4 in which the succeeding document D2 that has been preliminarily fed is transported to the scanning position 405, the foregoing steps b4–b11 being repeated during which time the preliminary feeding of a further succeeding document D3 is performed. FIG. 31(5) shows the condition in which the preliminary feeding of the succeeding document D3 is completed while the first document D1 is discharged.

Thereafter, when the last document D4 has been transported to the scanning position 405*a* after preliminary feeding, the decision at step b6 goes affirmative, causing the process to proceed to step b12. At step b12, it is decided if both sides of the documents have been copied. If the decision is negative, the process returns to step b7 in which the document D1 is again preliminarily fed this time for copying of the other side thereof, thus initiating the second circulation of the documents. After repeating the steps b4–b12, when it is decided at step b12 that both sides of the documents have been copied, the process now proceeds to step b8 and, without performing preliminary feeding, the program terminates after completing the copying operation for the document D4.

Thus, according to the present embodiment, not only the size of the inverting means 418 is reduced but also the preliminary feeding can be performed properly. As a result, the time needed to sequentially transport a plurality of documents to the scanning position can be reduced markedly, which eventually leads to a marked reduction in copying time.

The above embodiment has been described in connection with the construction of an electrostatic image transfer copying machine, but it will be appreciated that this embodiment can also be applied to a construction in which copying is made, for example, on photosensitized recording paper.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A document feeding apparatus comprising:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, a prescribed number of pressure rollers counted from the upstream end in the transporting direction are controlled individually in the sequence in which the are arranged in such a manner as to release their pressures from the belt in accordance with the length of the document measured along the transporting direction.

2. A document feeding apparatus as set forth in claim 1, wherein the plurality of pressure rollers controlled to release pressure include a first pressure roller disposed at the upstream end with respect to the transporting direction and a second pressure roller disposed on the downstream side of the first pressure roller with respect to the transporting direction.

3. A document feeding apparatus as set forth in claim 2, further comprising a stop member provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and the first pressure roller but greater than the distance between the stop member and the second pressure roller, the first and second pressure rollers are not controlled to release pressure, allowing the succeeding document to be fed until the leading edge thereof contacts the first pressure roller via the belt.

4. A document feeding apparatus as set forth in claim 3, wherein when the length, measured along the transporting direction, of the document positioned on the document scanning area is smaller than the distance between the stop member and the second pressure roller but greater than the distance between the stop member and a third pressure roller disposed on the downstream side of the second pressure roller in the transporting direction, the first pressure roller is controlled so as to release its pressure so that the succeeding document is fed until the leading edge thereof contacts the second pressure roller via the belt.

5. A document feeding apparatus as set forth in claim 4, wherein when the length, measured along the transporting direction, of the document positioned on the document scanning area is smaller than the distance between the stop member and the third pressure roller, the first and second pressure rollers are controlled so as to reduce their pressures so that the succeeding document is fed until the leading edge thereof contacts the third pressure roller via the belt.

6. A document feeding apparatus comprising:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, the pressure roller disposed at the upstream end with respect to the transporting direction is controlled in such a manner as to reduce its pressure according to the length of the document measured along the transporting direction.

7. A document feeding apparatus as set forth in claim 6, wherein said pressure roller is moved vertically in a stepwise manner between the lowermost position at which said pressure roller is pressed against the document scanning area via the belt and the uppermost position at which said pressure roller is not in contact with the belt.

8. A document feeding apparatus as set forth in claim 7, further comprising a stop member provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and said pressure roller but greater than the distance between the stop member and the other pressure rollers disposed downstream of said pressure roller, the amount of elevation of said pressure roller is controlled in accordance with the length of the document so that the succeeding document is fed until the leading edge thereof contacts the belt.

9. A document feeding apparatus as set forth in claim 8, wherein when the length, measured along the transporting direction, of the document positioned on the document scanning area is smaller than the distance between the stop member and the other pressure rollers, said pressure roller is moved up to the uppermost position so that the succeeding document is fed until the leading edge thereof contacts the first of the other rollers via the belt.

10. A document feeding apparatus comprising:

a belt for feeding a document sheet onto a document scanning area of a copying machine; and a plurality of pressure rollers disposed along the transporting direction of the document for pressing the document being transported against the document scanning area via the belt, wherein:

when the preceding document is positioned on the document scanning area, the pressure roller disposed at the upstream end with respect to the transporting direction is controlled in such a manner as to shift its pressing position toward the downstream side in the transporting direction in accordance with the length of the document measured along the transporting direction.

11. A document feeding apparatus as set forth in claim 10, wherein the upstream end pressure roller is displaced in a stepwise manner between a first prescribed position and a second position downstream of the first position in the transporting direction.

12. A document feeding apparatus as set forth in claim 11, further comprising a stop member provided at the downstream end of the document scanning area in the transporting direction, the stop member contacting with the leading edge of the document so as to limit the document scanning position, wherein:

when the length, measured along the transporting direction, of the document positioned on the document scanning area is smaller than the distance between the stop member and the first position but greater than the distance between the stop member and the second position, the amount of the displacement of the upstream end pressure roller is controlled in accordance with the length of the document so that the subsequent document is fed until the leading edge thereof contacts the upstream end pressure roller via the belt.

13. A document feeding apparatus as set forth in claim 12, wherein when the length, measured along the transporting direction, of the document positioned on the document scanning area is smaller than the distance between the stop member and the second position, the upstream end pressure roller is moved to the second position so that the succeeding document is fed until the leading edge thereof contacts the upstream end pressure roller via the belt.

14. A document feeding apparatus for feeding document sheets stacked on a document loading tray and transporting the document sheets sequentially and successively by a belt to a document scanning area facing optical scanning means, wherein:

a drum rotatable about its axis having a first branching transport path about a portion of the periphery of said drum in a first direction for reversing the transporting direction of the document for duplex copying and a second branching transport path about a portion of the periphery of said drum in a direction opposite to said first direction for turning over the document for simplex copying is provided between the document loading tray and the document scanning area;

a clearance is formed between the belt and the document scanning area on the upstream side with respect to the transporting direction, the clearance serving as a third transport path into which the transport paths of the inverting means merger; and a plurality of pressure rollers disposed along the belt for pressing the document being transported against the document scanning area, a prescribed number of said pressure rollers counted from the upstream end in the transporting direction being controlled individually in the sequence in which they are arranged in such a manner as to release their pressures to adjust said clearance in accordance with the length of the document measured along the transporting direction.

15. A document feeding apparatus as set forth in claim 14, wherein when the document is positioned on the document scanning area, the succeeding document is transported for standby until the leading edge thereof enters the third transport path and contacts the belt.

16. A document feeding method for feeding document sheets stacked on a document loading tray and transporting the document sheets successively by a belt to a document scanning area facing an optical scanning means, comprising:

releasing pressure applied by a prescribed number of pressure rollers to the belt on the upstream side with respect to the document transporting direction to form a clearance between the belt and the document scanning area on the upstream side with respect to the document transporting direction; and transporting the succeeding document for standby until the leading edge thereof enters the clearance and contacts the belt, when the document is positioned on the document scanning area.

* * * * *